US005131865A

United States Patent [19]

Taguchi et al.

[11] Patent Number: 5,131,865

[45] Date of Patent: Jul. 21, 1992

[54] CONNECTOR APPARATUS WITH COUPLING DETECTING FUNCTION

[75] Inventors: Naoto Taguchi; Tetsuo Kato; Akira Maeda, all of Shizuoka, Japan

[73] Assignee: Yazaki Corporation, Tokyo, Japan

[21] Appl. No.: 658,484

[22] Filed: Feb. 20, 1991

[30] Foreign Application Priority Data

| | | | |
|---|---|---|---|
| Feb. 21, 1990 | [JP] | Japan | 2-38494 |
| Mar. 23, 1990 | [JP] | Japan | 2-72062 |
| Mar. 23, 1990 | [JP] | Japan | 2-72064 |
| Jul. 18, 1990 | [JP] | Japan | 2-75551[U] |

[51] Int. Cl.[5] ..... H01R 3/00

[52] U.S. Cl. ..... 439/489

[58] Field of Search ..... 439/188, 488, 489, 490, 439/491; 200/51 R, 51.09

[56] References Cited

U.S. PATENT DOCUMENTS

| | | | |
|---|---|---|---|
| 3,275,765 | 10/1966 | Ferdon et al. | 200/51.1 |
| 4,070,557 | 1/1978 | Ostapovitch | 200/51.1 |
| 4,179,173 | 12/1979 | Rise, III . | |
| 4,224,486 | 9/1980 | Zimmerman et al. | 200/51.1 |
| 4,449,778 | 5/1984 | Lane . | |
| 4,477,134 | 10/1984 | Wright . | |
| 4,482,198 | 11/1984 | Crowley . | |
| 4,552,423 | 11/1985 | Swengel, Jr. . | |
| 4,582,376 | 4/1986 | Olsson . | |
| 4,685,887 | 11/1987 | Hanning | 439/188 |
| 4,786,258 | 11/1988 | Shaffer et al. | 439/188 |
| 4,832,614 | 5/1989 | Jenkins | 439/188 |
| 4,900,267 | 2/1990 | Nagaraka et al. | 439/489 |
| 4,915,649 | 4/1990 | Shimazu et al. | 439/489 X |

FOREIGN PATENT DOCUMENTS

| | | |
|---|---|---|
| 7008923 | 11/1971 | France . |
| 65-16080 | 1/1989 | Japan . |
| 2081526 | 2/1982 | United Kingdom . |

*Primary Examiner*—Larry I. Schwartz
*Assistant Examiner*—Khiem Nguyen
*Attorney, Agent, or Firm*—Armstrong, Nikaido, Marmelstein, Kobovcik & Murray

[57] ABSTRACT

A connector apparatus having a coupling detecting function which has a highly reliable electric connection between the coupling detecting electrical contact elements. The connector apparatus includes a resilient locking arm and a cooperable engaging element provided on first and second housings, respectively. A pair of coupling detecting contact elements are disposed in a movement-permitting spacing of the first housing for the locking arm, and each has a contact portion which is displaced in response to displacement of the locking arm. A short-circuiting contact element is secured to the engaging element. When the two housings are coupled completely to each other, the coupling detecting contact elements are allowed to contact with the short-circulating element to establish an electrical connection between them. When the two housings are not coupled completely to each other, the engaging element displaces the locking arm to disengage the coupling detecting contact elements from the short-circuiting contact elements to interrupt an electrical connection between the coupling detecting contact element.

8 Claims, 21 Drawing Sheets

CONNECTOR APPARATUS WITH COUPLING DETECTING FUNCTION

BACKGROUND OF THE INVENTION

1. Field of the Invention

This invention relates to a connector apparatus having a coupling detecting function for detecting whether or not a pair of connector housings for use for the connection of a wire harness of an automobile or the like are properly coupled to each other.

2. Description of the Prior Art

Various connector apparatus which have such a coupling detecting function as mentioned above are conventionally known. An notably example of a conventional connector apparatus is shown in FIGS. 29, 30*a* and 30*b*. Referring to FIGS. 29, 30*a* and 30*b*, the connector apparatus shown includes a pair of connector housings 302 and 304. The connector housing 302 has a contact element accommodating chamber 306 formed therein for accommodating a pair of electric contact elements 308 and 310 in a non-contacting condition while the other connector housing 304 has an operating piece 312 in the form of a resilient cantilever formed thereon and having a free end 314 for engaging with the electric contact element 310 to compulsorily contact the electric contact element 310 with the other electric contact element 308. The connector housing 302 further has an interfering projected portion 316 provided forward of the electrical contact element 310 for contacting, when the connector housings 302 and 304 are not coupled completely to each other, with the free end 314 of the operating piece 312 of the connecting housing 304 so as to resiliently displace the same downwardly as shown in phantom lines in FIG. 30*b* thereby leaving the electric contact element 310 in a spaced condition from the other electrical contact element 308. However, when the connector housings 302 and 304 are coupled completely to each other, the interfering projected portion 316 of the connector housing 302 is received into an opening 318 formed in the operating piece 312 to allow the operating piece 312 to be returned from the phantom position to another original solid line position, as shown in FIG. 30*b*, by its own resiliency. Consequently, the contact element 310 is contacted with the other contact element 308 to close a coupling detecting electric circuit in which the electric contact elements 308 and 310 are included.

According to the structure of the connector apparatus, the accommodating chamber 306 for the detecting electric contact elements 308 and 310 is required for the connector housing 302. Accordingly, the connector housing 302 is complicated in profile, which makes molding of resin difficult and cumbersome as much. Further, if the connector apparatus is used in a high temperature environment, the operating piece 312 made of a resin material may suffer from thermal deformation, which in turn will decrease the compulsive force of the operating piece 312 to act upon the electric contact element 310. Consequently, the reliability of the electric connection between the electric contact elements 308 and 310 is deteriorated.

Another example one of a conventional connector apparatus is shown in FIG. 31. Referring to FIG. 31, the connector apparatus shown includes a female connector housing 332 having a pair of coupling detecting terminals 334 and a bifurcated short-circuiting element 336 provided on an outer face thereof. A piece 338 of the bifurcated short-circuiting element 336 is normally held in contact with the coupling detecting element 334 while the other piece 340 is normally held out of contact with the other coupling detecting terminal 334.

Then, if the female connector housing 332 is coupled to a companion male connector housing 342 as seen in FIG. 32, then a resilient locking piece 344 of the male connector housing 342 will ride over and be engaged with an arresting projection 346 on the outer face of the female connector housing 332, thereby locking the female and male connector housings 332 and 342 in a coupled condition. In this instance, an end portion 348 of the resilient locking piece 344 of the male connector housing 342 presses against the piece 340 of the bifurcated short-circuiting element 336 to contact the piece 340 with the opposing coupling detecting terminal 334 as seen in FIG. 32, thereby establishing electric connection between the coupling detecting terminals 334.

According to the structure of the connector apparatus, since the short-circuiting element 336 constituting part of a coupling detecting circuit is exposed outside, it is likely acted upon and deformed by an external force, which deteriorates stabilized contact between the short-circuiting element 336 and the coupling detecting terminals 334. Consequently, operation of the detecting circuit is low in reliability.

SUMMARY OF THE INVENTION

It is an object of the present invention to provide a connector apparatus which eliminates the necessity of providing an accommodating chamber for exclusive use in coupling detecting electric contact elements and which is simplified in its a connector housing profile.

It is another object of the present invention to provide a connector apparatus which is highly reliable in its electric connection between coupling detecting electric contact elements.

It is a further object of the present invention to provide a connector apparatus which eliminates the influence of an external force, which may possibly act upon a short-circuiting member constituting part of a coupling detecting circuit, so as to assure a stabilized detecting operation of the coupling detecting circuit.

In order to attain the above objects, according to one aspect of the present invention, there is provided a connector apparatus which includes first and second connector housings, a resilient locking arm provided on the first connector housing, an engaging element provided on the second connector housing for engaging with the resilient locking arm so as to lock the first and second connector housings in a completely coupled condition, a pair of coupling detecting contact elements disposed in a spacing of the first connector housing which allows resilient movement of the resilient locking arm therein, each of the coupling detecting contact elements having a contact portion which is displaced in response to displacement of the resilient locking arm, and a short-circuiting contact element secured to the engaging element of the second connector housing. The resilient locking arm is constructed such that, when the first and second connector housings are coupled completely to each other, the engaging element does not interfere with the resilient locking arm and allows the resilient rocking arm to assume an operative position at which the coupling detecting contact elements contact with the short-circuiting contact element. The contact with short-circuiting contact element establishes the electrical connection between the coupling detecting contact elements. However, when the first and second connector housings are not coupled completely to each other, the engaging element engages with and displaces the resilient locking arm away from the operative position to interrupt the electrical connection between the coupling detecting contact elements.

With the connector apparatus, the coupling detecting contact elements and short-circuiting contact element can be incorporated in the apparatus without particularly complicating the structure of any connector housing. Further, a stabilized contact force between the coupling detecting contact elements and the short-circuiting contact element is assured, and as a result, a highly reliable of electrical connection is assured.

According to another aspect of the present invention, there is provided a connector apparatus which includes first and second connector housings, a resilient locking arm provided on the first connector housing, an engaging element provided on the second connector housing for engaging with the resilient locking arm to lock the first and second connector housings in a completely coupled condition, a pair of resilient coupling detecting contact elements provided on the first connector housing with each having a contact portion which is resiliently displaced in response to displacement of the resilient locking arm, and a short-circuiting contact element secured to the second connector housing. The resilient locking arm is constructed such that, when the first and second connector housings are coupled completely to each other, the engaging element does not interfere with the resilient locking arm and allows the resilient rocking arm to assume an operative position at which the coupling detecting contact elements contact at the resilient contact ends thereof with the short-circuiting contact element establishing electric connection between the coupling detecting contact elements. However, when the first and second connector housings are not coupled completely to each other, the engaging element engages with and displaces the resilient locking arm away from the operative position to interrupt electric connection between the coupling detecting contact elements.

Also with the connector apparatus, the coupling detecting contact elements and short-circuiting contact element can be incorporated in the apparatus without particularly complicating the structure of the connector housing. Further, a stabilized contact force between the coupling detecting contact elements and short-circuiting contact element is assured, and thus a high reliable electrical connection is assured.

According to a further aspect of the present invention, there is provided a connector apparatus which incorporates male and female connector housings, the male connector housing having a recessed portion formed thereon and further having a pair of contact element accommodating chambers formed therein on opposite sides of the recessed portion, a resilient locking arm provided on the recessed portion of the male connector housing, a pair of coupling detecting contact elements accommodated in the contact element accommodating chambers, a first short-circuiting metal element provided on the resilient locking arm in an opposing relationship to the coupling detecting contact elements such that a gap is left between the first short-circuiting metal element and at least one of the coupling detecting contact elements, an engaging element provided at a casing portion of the female connector housing for engaging with the resilient locking arm to lock the male and female connector housings in a completely coupled condition, and a second short-circuiting metal element provided on the casing portion of the female connector housing in an opposing relationship to the gap or each of the gaps. When the male and female connector housings are coupled completely to each other, the second short-circuiting metal element is fitted between the first short-circuiting metal element and the one coupling detecting contact element so as to establish an electrical connection between the coupling detecting contact elements.

According to a still further aspect of the present invention, there is provided a connector apparatus which includes male and female connector housings, the male connector housing having a recessed portion-formed thereon along with a pair of contact element accommodating chambers formed therein on the opposite sides of the recessed portion, a resilient locking arm provided on the recessed portion of the male connector housing, a pair of coupling detecting contact elements accommodated in the contact element accommodating chambers, a short-circuiting metal element provided on the resilient locking arm and held in contact with the coupling detecting contact elements, an engaging element provided at a casing portion of the female connector housing for engaging with the resilient locking arm to lock the male and female connector housings in a completely coupled condition, and a fitting wall provided on the casing portion of the female connector housing in an opposing relationship to a location at which the short-circuiting metal element contacts with one of the coupling detecting contact elements. When the male and female connector housings are coupled completely to each other, the fitting wall is fitted between the short-circuiting metal element and the one coupling detecting contact element to interrupt the electric connection between the coupling detecting contact elements.

With the two connector apparatus, the potentially harmful influence of an external force which may act upon the short-circuiting metal element constituting part of a coupling detecting circuit for the connector apparatus can be eliminated. Consequently, a stabilized detecting operation of the coupling detecting circuit is assured.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
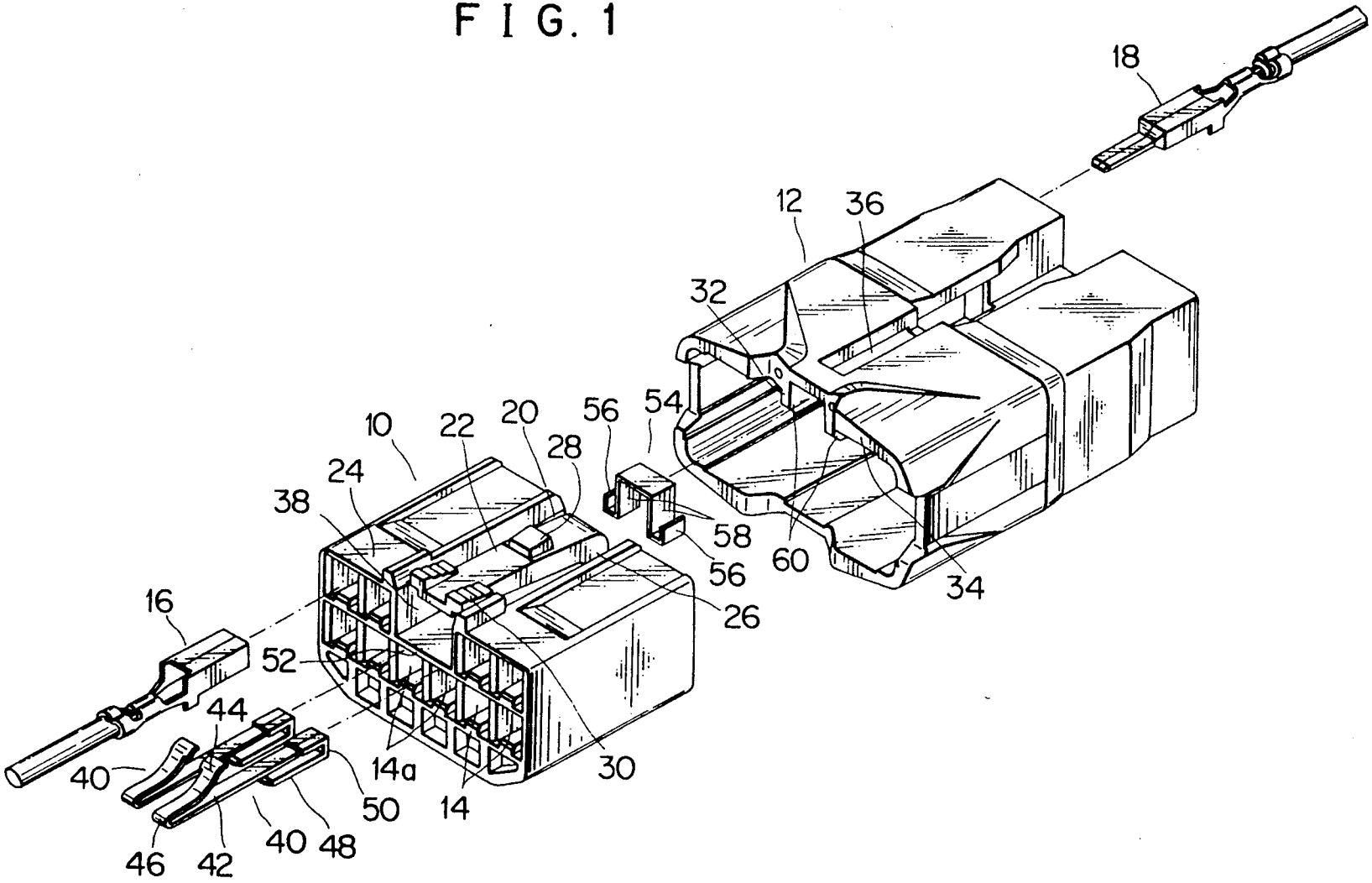
FIG. 1 is a fragmentary perspective view of a connector apparatus showing a first preferred embodiment of the present invention.

Referring first to FIGS. 1 to 3*c*, there is shown a connector apparatus with a coupling detecting function according to a first preferred embodiment of the present invention. The connector apparatus includes a male connector housing 10 and a female connector housing 12 both made of a synthetic resin material.

The male connector housing 10 has a plurality of terminal accommodating chambers 14 formed therein, and a female terminal metal element 16 is inserted and arrested in position in each of the terminal accommodating chambers 14 similarly as in a conventional connector apparatus. Though not shown, the female connector housing 12 also has a plurality of terminal accommodating chambers formed therein, and a male terminal metal element 18 is inserted and arrested in position in each of the terminal accommodating chambers of the female connector housing 12.

A recessed portion 20 is formed on a top wall 24 of the male connector housing 10, and a resilient arm 22 in the form of a cantilever having a base portion 26 at a front end thereof is formed on and extends rearwardly from the male connector housing 10 in the recessed portion 20. A locking projection 28 is formed on an upper face of a mid portion of the resilient arm 22 while an unlocking depressing operating member 30 is provided at a free end of the resilient arm 22. An engaging frame portion 32 for engaging with the resilient arm 22 is formed at a widthwise mid-portion of a front portion of an upper wall 34 of the female connector housing 12 while an arresting hole 36 for arresting the locking projection 28 is formed in the upper wall 34 of the female connector housing 12.

Such structure of the connector apparatus as described above is conventionally known. With such a structure, when the female and male connector housings 10 and 12 are coupled to each other, the female and male terminal metal elements 16 and 18 are contacted with each other. Thereupon, the resilient locking arm 22 of the male connector housing 10 is first resiliently deformed downwardly, as the locking projection 28 thereof is engaged by the engaging frame portion 32 of the female connector housing 12, into a deformation permitting spacing 38 in the male connector housing 10, and is then returned to its original position by its own resiliency when the locking projection 28 thereon is snapped into the arresting hole 36 of the upper wall 34 of the female connector housing 12.

The male connector housing 10 further has a pair of coupling detecting contact elements 40 accommodated therein. Each of the coupling detecting contact elements 40 has a main plate portion 42 and a resilient contact portion 44 extending obliquely upwardly from an end of the main plate portion 42 by way of a folded back portion 46. Each of the coupling detecting contact elements 40 further has a tab-like male terminal portion 48 extending rearwardly from the other end of the main plate portion 42 by way of another folded back portion 50 which extends in the opposite direction to the folded back portion 46. The coupling detecting contact elements 40 are mounted fixedly on the male connector housing 10 such that the folded back portions 46 thereof are fitted at an end portion of a partition wall 52 between the recessed portion 20 and a pair 14*a* of the terminal accommodating chambers 14 which are located adjacent the recessed portion 20. Thus, the resilient contact portions 44 of the coupling detecting contact elements 40 are positioned in an obliquely upwardly erected condition in the deformation permitting spacing 38 in an opposing relationship to a lower face of the free end portion of the resilient locking arm 22, while the tab-like male terminal portions 48 are directed rearwardly in the terminal accommodating chambers 14*a*. Such normal female terminal metal elements 16 as described above are connected also to the tab-like male terminal portions 48 of the coupling detecting contact elements 40 to generally constitute a detecting circuit.

Meanwhile, the female connector housing 12 has a short-circuiting contact element 54 accommodated therein. The short-circuiting contact element 54 is formed from a resilient metal plate having a gate-like shape when viewed in front elevation. The short-circuiting contact element 54 has a pair of outwardly folded back contact portions 56 at the opposite ends of a pair of leg portions 58 thereof. The short-circuiting contact element 54 is secured to the female connector housing 12 with the folded back contact portions 56 thereof fitted with a pair of opposing plate portions 60 of the engaging frame portion 32 of the female connector housing 12.

Figure 4:
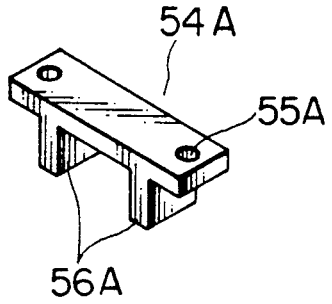
FIG. 4 is a perspective view of a short-circuiting contact element of an alternative form.

It is to be noted that the short-circuiting contact element 54 may be replaced by a short-circuiting contact element 54A such as that shown in FIG. 4. The short-circuiting contact element 54A of FIG. 4 is formed as a thick metal frame member and may be integrated with the engaging frame portion 32 of the female connector housing 12 by insert molding such that contact portions 56A thereof are left exposed. Reference character 55A denotes a resin pouring hole for such an insert molding.

Figure 2A:
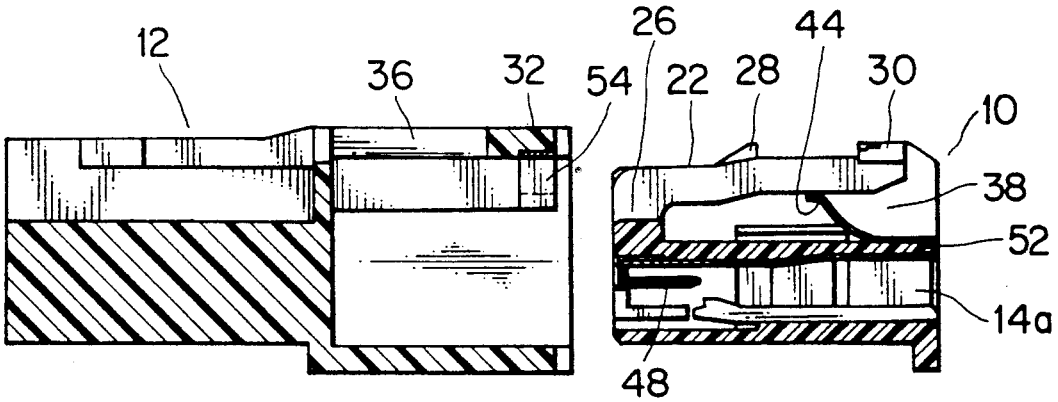
FIGS. 2*a*, 2*b*, 2*c* and 3*a*, 3*b*, 3*c* are longitudinal sectional views and transverse sectional views, respectively, of the connector apparatus of FIG. 1 showing a pair of connector housings at different stages during a coupling operation.
Figure 2B:
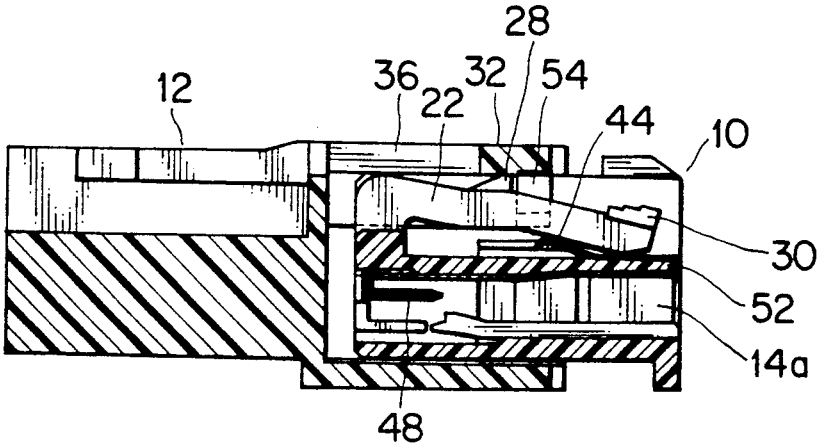
Figure 2C:
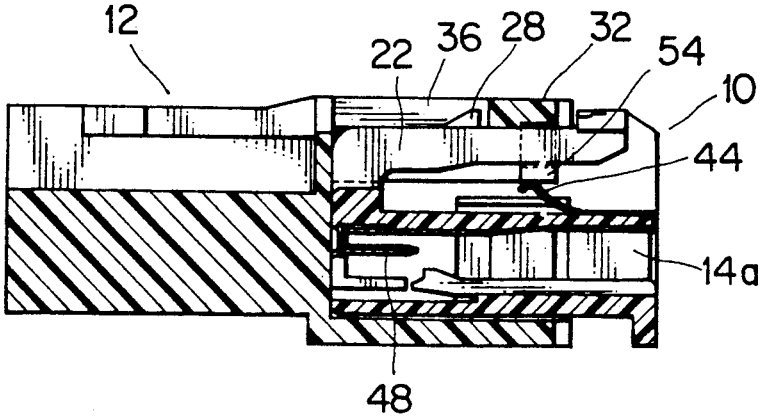
Figure 3A:
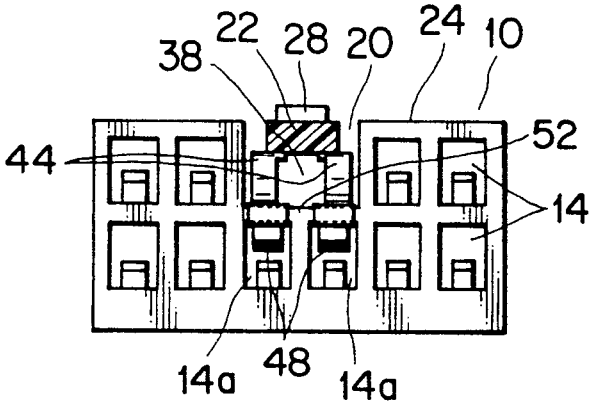
Figure 3B:
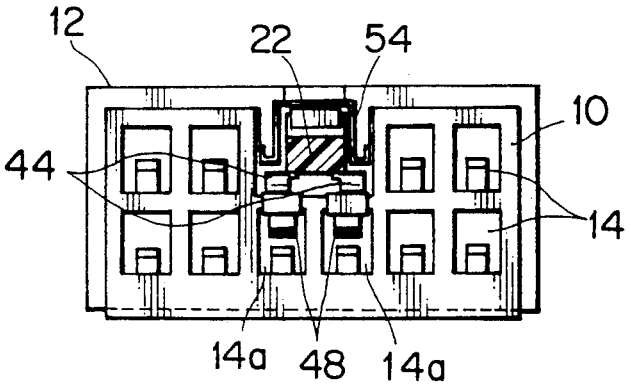
Figure 3C:
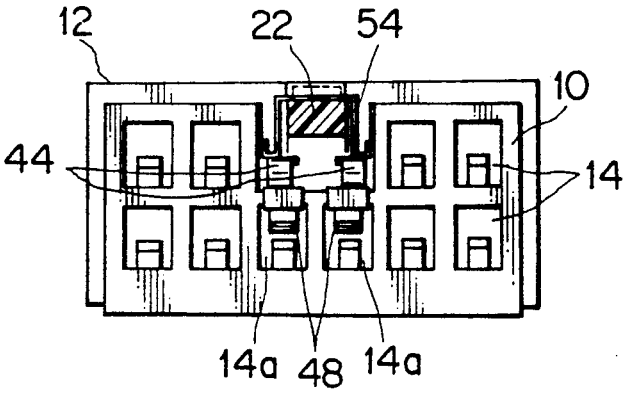
Figure 9:
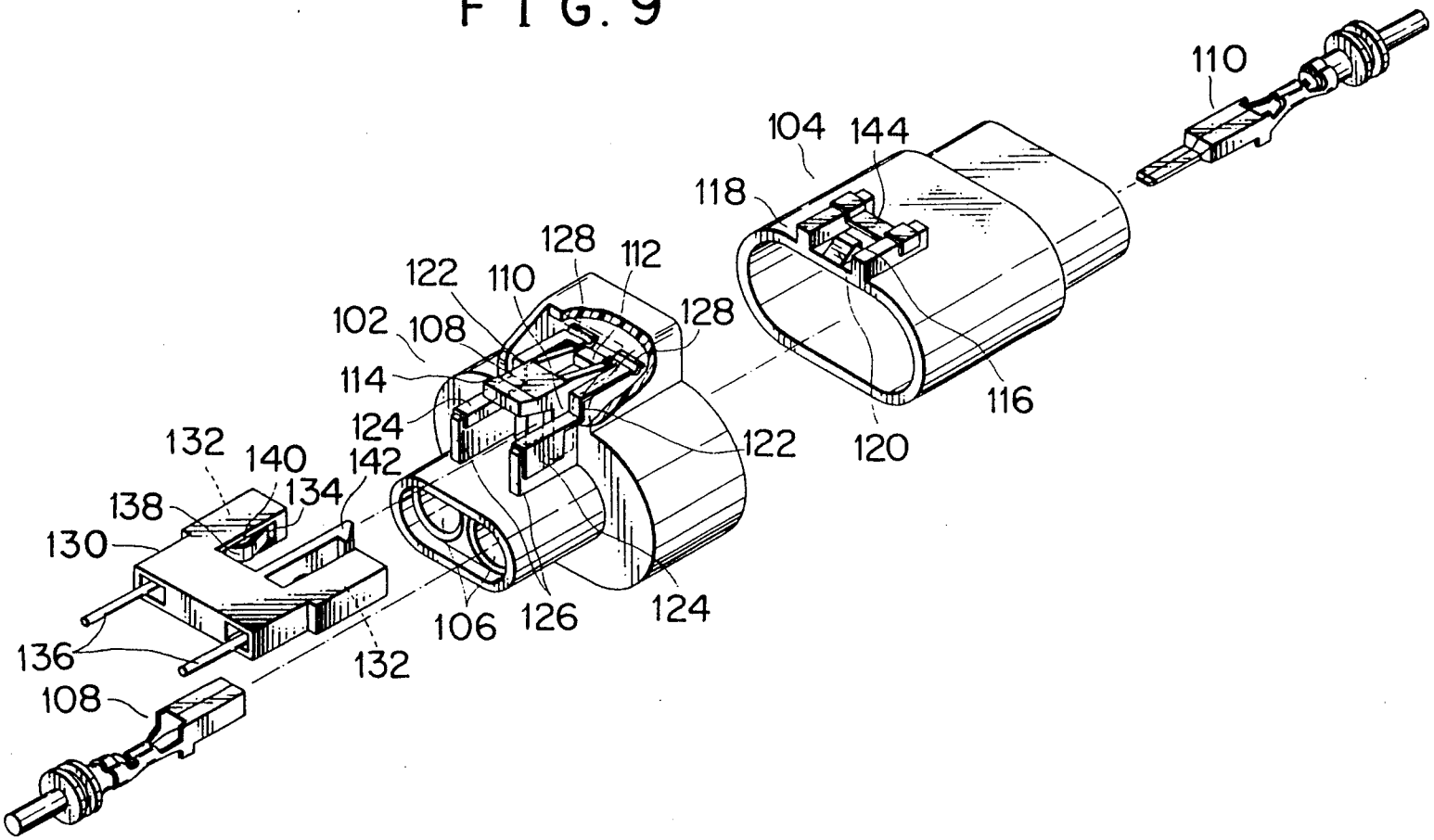
FIG. 9 is a fragmentary perspective view of a further connector apparatus showing a second preferred embodiment of the present invention.

With the connector apparatus of the construction described above, when the female and male connector housings 10 and 12 are not coupled completely to each other, the free end portion of the resilient locking arm 22 of the male connector housing 10 is displaced downwardly by engagement between the engaging frame portion 32 of the female connector housing 12 and the locking projection 28 on the resilient locking arm 22 to compulsorily displace the resilient contact portions 44 of the coupling detecting contact elements 40 downwardly as seen in FIGS. 2*b* and 3*b*. Accordingly, the short-circuiting contact element 54 remains out of contact with the resilient contact portions 44 of the coupling detecting contact elements 40. Consequently, the coupling detecting contact elements 40 are not short-circuited by the short-circuiting contact element 54 and the detecting electric circuit does not operate.

On the other hand, if the male and female connector housings 10 and 12 are coupled completely to each other, then the resilient locking arm 22 is restored to its original position due to its resiliency. Consequently the coupling detecting contact elements 40 also are restored to their original positions due to their own resiliency. Further, the resilient contact portions 44 of the coupling detecting contact elements 40 are contacted with the short-circuiting contact element 54, thereby establishing an electrical connection between the coupling detecting contact elements 40 and causing the detecting electric circuit to operate.

Figure 5:
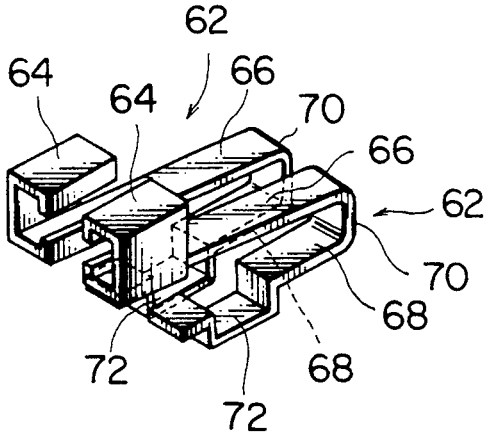
FIG. 5 is a perspective view of a pair of coupling detecting contact elements of an alternative form.

Referring now to FIG. 5, there are shown a pair of coupling detecting contact elements of a different form. The coupling detecting contact elements 62 have generally symmetrical structures relative to each other. Each of the coupling detecting contact elements 62 has a channel-shaped contact portion 64 formed uprightly at an end of a main plate portion 66, and further each has a rearwardly extending connecting portion 68 formed at the other end of the main plate portion 66 by way of a resilient folded back portion 70. Each of the coupling detecting contact elements 62 in addition has a projected terminal portion 72 formed at the other end of the connecting portion 68 by bending such that it extends downwardly away from the main plate portion 66.

Figure 6:
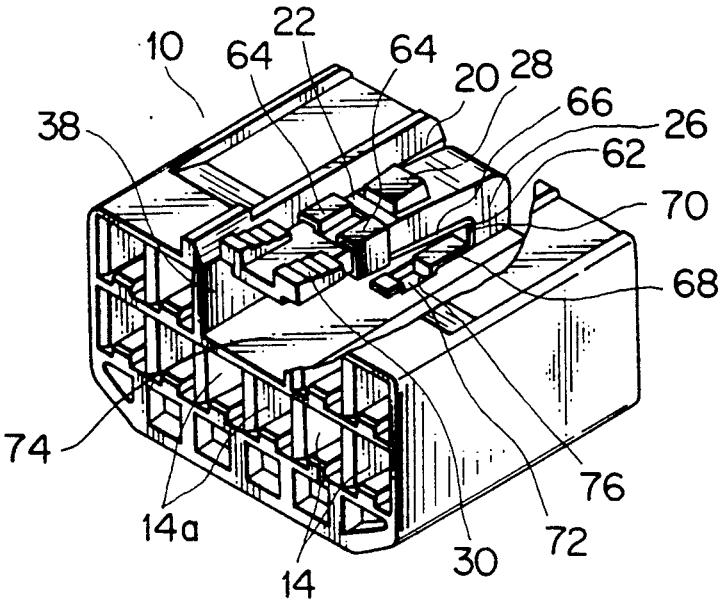
FIG. 6 is a perspective view, partly broken, showing a modified connector housing in which the coupling detecting contact elements shown in FIG. 5 are incorporated.

The coupling detecting contact elements 62 are incorporated in pairs in a modified male connector housing 10 such as that shown in FIG. 6. In particular, the coupling detecting contact elements 62 are mounted fixedly at a free end portion of the resilient locking arm by fixing means such as adhesion with the channel-shaped contact portions 64 thereof fitted on the opposite side edges of the free end portion of the resilient locking arm 22 as seen in FIG. 6. Thus, the main plate portions 66 and resilient folded back portions 70 of the coupling detecting contact elements 62 extend along an inner face of the resilient locking arm 22 including the base portion 26 thereof, while the folded back connecting portions 68 of the coupling detecting contact elements 62 are disposed on an upper face of a top wall 74 of the recessed portion 20 of the female connector housing 12. Further, the projected terminal portions 72 of the coupling detecting contact elements 62 are fitted into a pair of through-holes 76 formed in the top wall of the male connector housing 10 such that they extend into the terminal accomodating chambers 14*a* so as to resiliently contact with the female terminal metal elements 16 and thus establish an electrical connection between them.

Figure 7A:
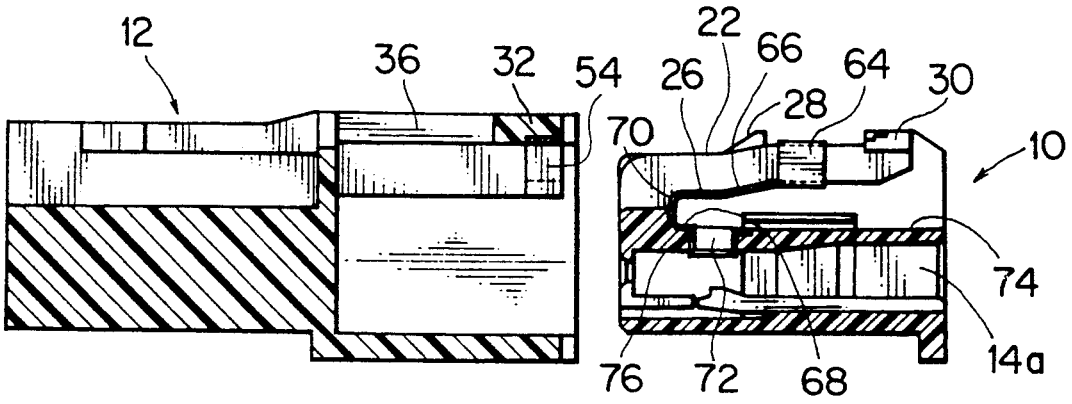
FIGS. 7*a*, 7*b*, 7*c* and 8*a*, 8*b*, 8*c* are longitudinal sectional views and transverse sectional views, respectively, of a modification to the connector apparatus of FIG. 1 showing a pair of connector housings at different stages during a coupling operation.
Figure 7B:
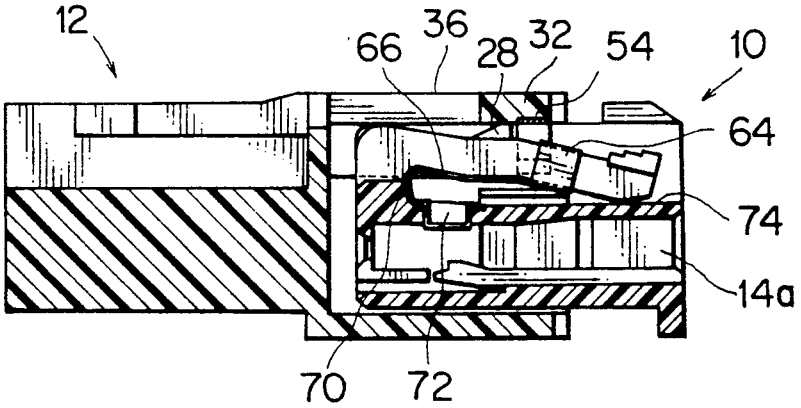
Figure 8A:
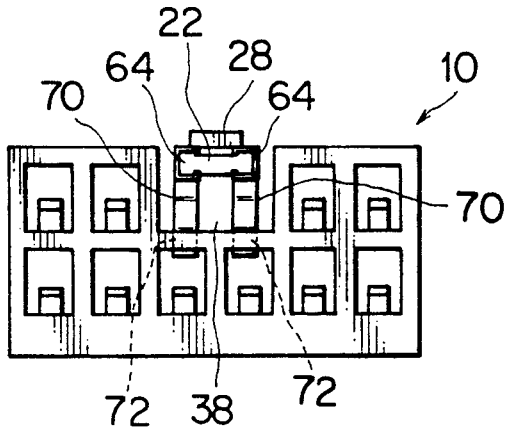
Figure 8B:
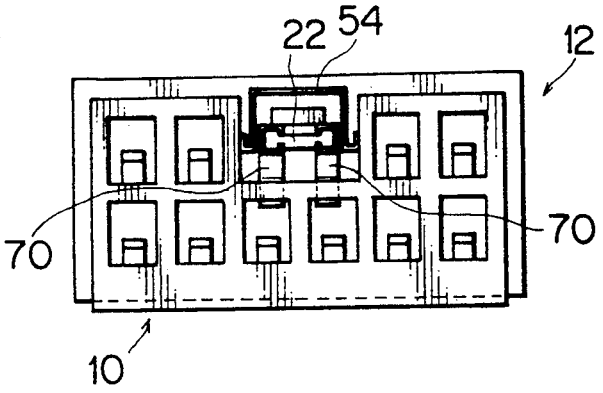

With the connector apparatus in which such a modified male connector housing 10 and coupling detecting contact elements 62 are incorporated, when the male and female connector housings 10 and 12 are not coupled completely to each other, the free end portion of the resilient locking arm 22 is displaced downwardly by engagement between the engaging frame portion 32 of the female connector housing 12 and the locking projection 28 on the resilient locking arm 22 as seen in FIGS. 7*b* and 8*b*. Consequently, the contact portions 64 of the coupling detecting contact elements 62 are kept out of contact with the short-circuiting contact element 54, and accordingly, the detecting electric circuit does not operate.

Figure 7C:
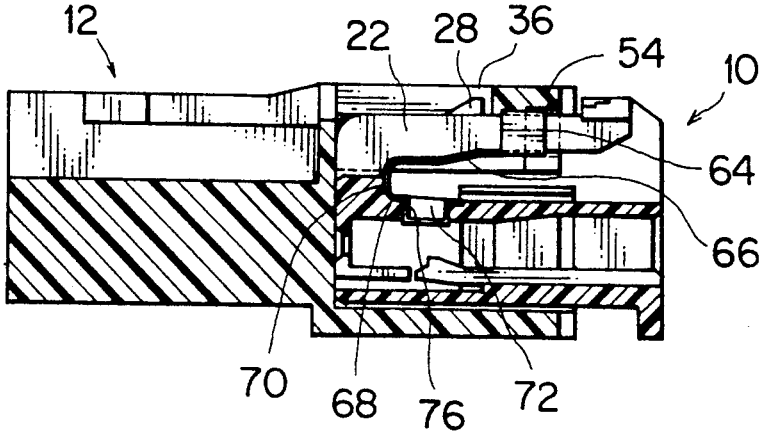
Figure 8C:
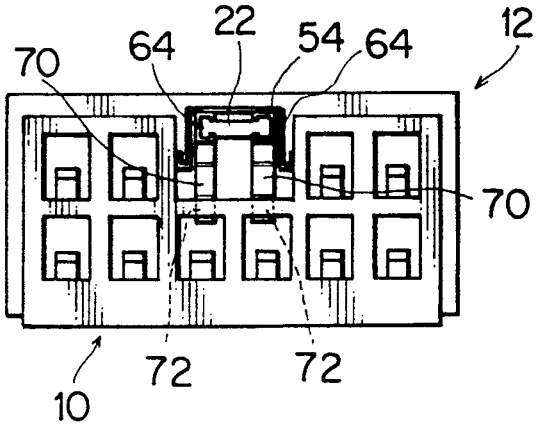
Figure 10:
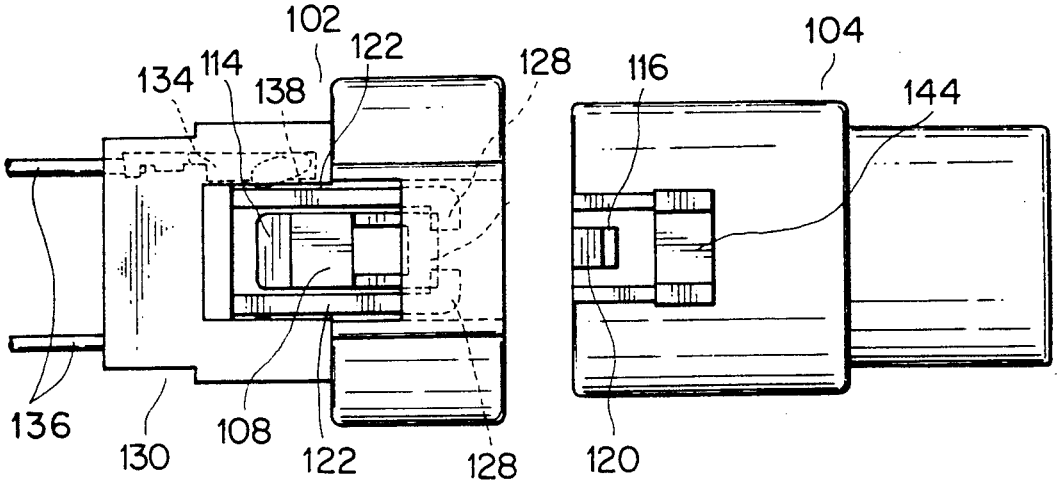
FIG. 10 is a plan view of the connector apparatus of FIG. 9 showing a pair of connector housings in a separated condition.

If the male and female connector housings 10 and 12 are coupled completely to each other, then the resilient locking arm 22 is returned to its original position by its own resiliency as seen in FIGS. 7*c* and 8*c*. Consequently, the contact portions 64 of the coupling detecting contact elements 62 are contacted with the short-circuiting contact element 54, thereby causing the detecting circuit to operate.

Referring the first to FIGS. 9 to 11*c*, there is shown a connector apparatus with a coupling detecting function accoring to a second preferred embodiment of the present invention. The connector apparatus includes a male connector housing 102 and a female connector housing 104 both made of a synthetic resin material.

The male connector housing 102 has a plurality of terminal accommodating chambers 106 formed therein, and a female terminal metal element 108 is inserted and arrested in position in each of the terminal accommodating chambers 106 similarly as in a conventional connector apparatus. Though not shown, the female connector housing 104 also has a plurality of terminal accommodating chambers formed therein, and a male terminal metal element 110 is inserted and arrested in position in each of the terminal accommodating chambers of the female connector housing 104.

A resilient arm 108 is formed on an upper face of the male connector housing 102 by way of an intermediate flexible upright supporting portion 110, and extends in a forward and backward direction. A locking projection 112 is formed on an upper face of a front end of the resilient locking arm 108 while an unlocking depressing operating member 114 is provided at a rear end of the resilient locking arm 108. Meanwhile, an engaging portion 116 in the form of a projection for engaging with the locking projection 112 of the resilient locking arm 108 is formed at a front end of an upper wall 118 of the female connector housing 104.

Such a structure of the connector apparatus as described above is conventionally known. When the female and male connector housings 102 and 104 are coupled to each other, the female and male terminal metal elements 108 and 110 are contacted with each other. Thereupon, the resilient locking arm 108 of the male connector housing 102 is first resiliently deformed upwardly as the locking projection 112 thereof is engaged with a tapered guide face 120 of the engaging portion 116 of the female connector housing 104, from its original position and is then displaced downward by the resiliency of the resilient upright supporting portion 110 after the locking projection 112 rides over the engaging portion 116. It is to be noted that, while the resilient locking arm 108 is supported at a mid-portion thereof in the present embodiment, it may otherwise be formed as a generally resilient cantilever supported at an end portion thereof as in the preceding embodiment described hereinabove.

The male connector housing 102 further has a pair of coupling detecting contact elements 122 mounted thereon. Each of the coupling detecting contact elements 122 is secured to the male connector housing 102 with a channel-shaped fixing contact plate portion 124 thereof fitted on a corresponding one of a pair of support walls 126 formed on an upper wall of the male connector housing 102 on the opposite sides of the resilient locking arm 108. The coupling detecting contact elements 122 extend forwardly along the resilient locking arm 108 such that contact end portions 128 thereof extend forwardly from above the locking projection 112 of the resilient locking arm 108.

A connector housing 130 for a coupling detecting circuit is substantially channel-shaped in plan view and has a pair of terminal accommodating chambers 132 formed therein. A terminal metal element 134 for a coupling detecting circuit connected in advance to a wire 136 is accommodated in each of the terminal accommodating chambers 132 of the connector housing 130 and has a resilient contact piece 138 which extends to the inner side of the connector housing 130 through an inner through-hole 140 formed in the connector housing 130. The detecting circuit connector housing 130 is fixed to the male connector housing 102 such that the terminal accommodating chambers 132 thereof are fitted on the outer sides of the support walls 126 of the male connector housing 102 and a flexible locking piece 142 thereof is engaged with an inner side arresting face of one of the support walls 126. In this condition, the resilient contact pieces 138 of the detecting circuit terminal metal elements 134 contact with the fixing contact plate portions 124 of the coupling detecting contact elements 122. A short-circuiting contact element 144 is fixed to the female connector housing 104 rearward of the engaging portion 116 such that it opposes the resilient contact end portions 128 of the coupling detecting contact elements 122.

Figure 11A:
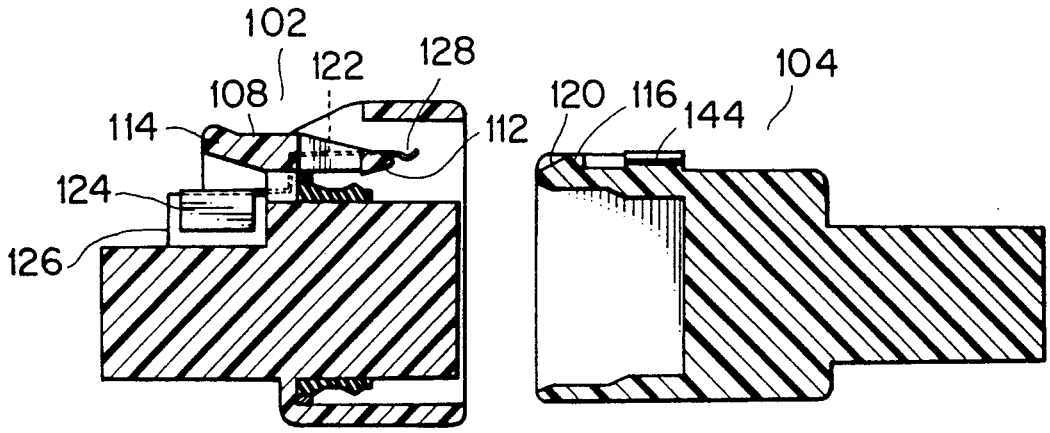
FIGS. 11*a*, 11*b* and 11*c* are longitudinal sectional views of the connector apparatus of FIG. 9 showing the connector housings at different stages during a coupling operation.
Figure 11B:
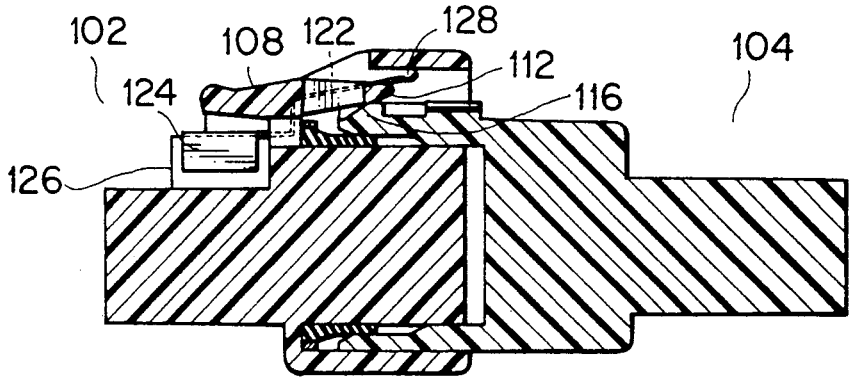
Figure 11C:
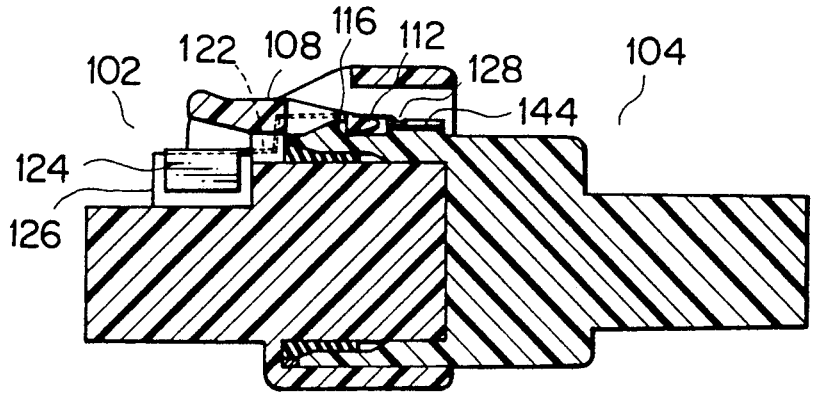
Figures 12, 13:
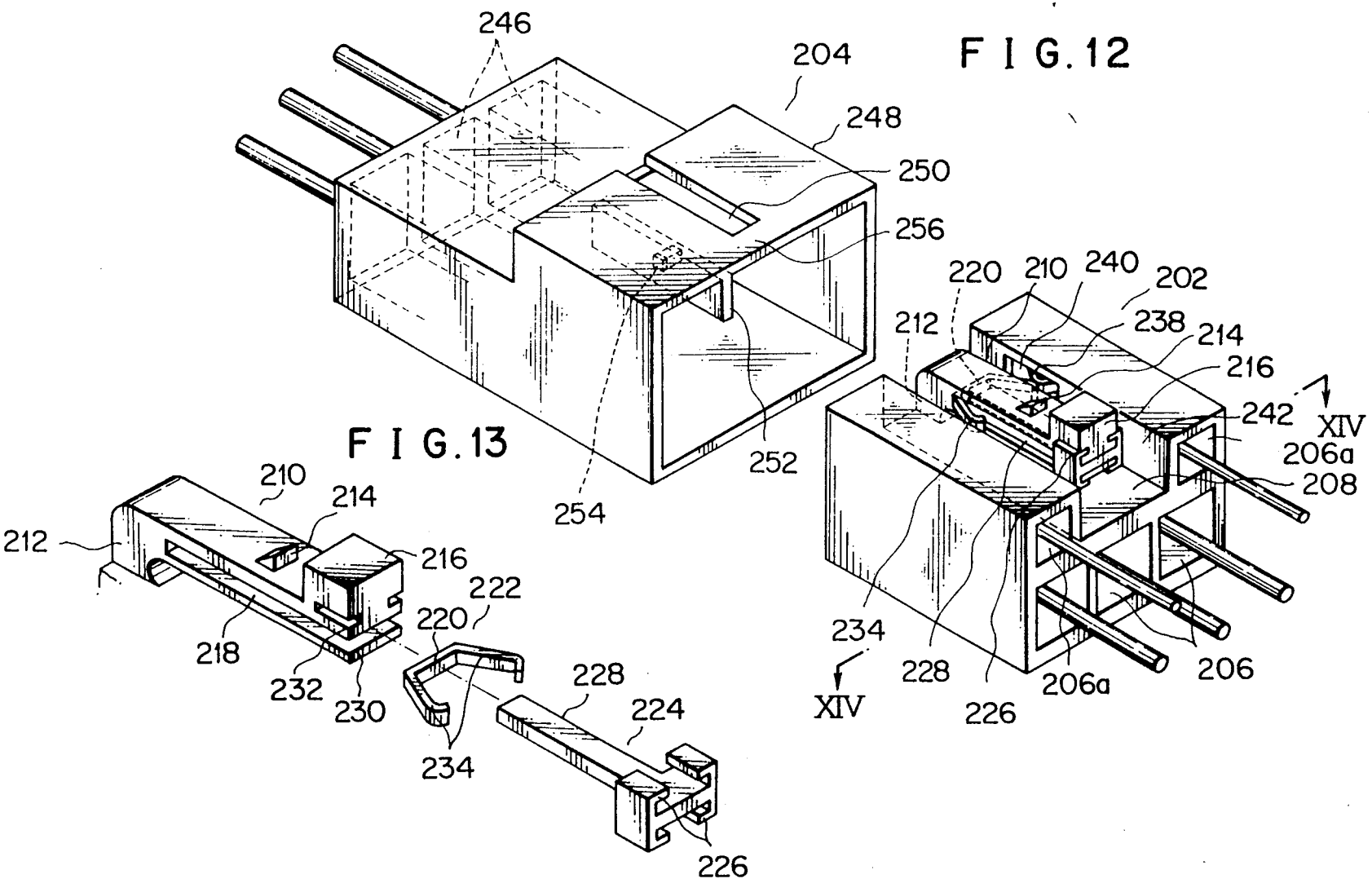
FIG. 12 is a fragmentary perspective view of a still further connector apparatus showing a third preferred embodiment of the present invention.
FIG. 13 is a fragmentary perspective view showing a resilient locking arm and cooperating members of the connector apparatus of FIG. 12.

With the connector apparatus of the construction described above, when the female and male connector housings 102 and 104 are coupled incompletely to each other, the locking projection 112 at the forward end of the resilient locking arm 108 of the male connector housing 102 is engaged with and displaced upwardly by the engaging portion 116 of the female connector housing 104 to compulsorily displace the resilient contact end portions 128 of the coupling detecting contact elements 122 upwardly as seen in FIGS. 11*b*. Consequently, the short-circuiting contact element 144 remains out of contact with the resilient contact end portions 128, and accordingly, the coupling detecting contact elements 122 are not short-circuited by the short-circuiting contact element 144 and the detecting electrical circuit does not operate.

If the female and male connector housings 102 and 104 are coupled completely to each other, then the resilient locking arm 108 restores its original positions due to the resiliency of the resilient upright supporting portion 110 so that it is engaged with and arrested by the engaging portion 116 of the female connector housing 104 after the locking projection 112 theron rides over the engaging portion 116. Consequently, the coupling detecting contact elements 122 are also restored to their original positions due to their own resiliency. Accordingly, the resilient contact end portions 128 of the coupling detecting contact elements 122 are in contact with the short-circuiting contact element 144. Further, the coupling detecting contact elements 122 and hence the terminal metal elements 134 are short-circuited by the short-circuiting contact element 144, thereby causing the detecting electric circuit to operate.

Referring first to FIGS. 12 to 16, there is shown a connector apparatus with a coupling detecting function according to a third preferred embodiment of the present invention. The connector apparatus includes a male connector having housing 202 and a female connector housing 204 both made of a synthetic resin material.

The male connecotr housing 202 has a plurality of terminal accommodating chambers 206 formed therein, and a recessed portion 208 is formed on the top of the male connector housing 202. A resilient locking arm 210 in the form of a cantilever having a base portion 212 at a front end thereof is formed on and extends rearwardly from the male connector housing 202 in the recessed portion 208. A locking projection 214 is formed on an upper face of a mid-portion of the resilient arm 210 while an unlocking depressing operating portion 216 is provided at a free end of the resilient arm 210.

The resilient locking arm 210 has a deep supporting groove 218 formed in a longitudinal direction from and end portion thereof, a mid portion 220 of a first short-circuiting metal element 222 is inserted in the supporting groove 218 and fixed to the resilient locking arm 210 by means of a fixing member 224. The fixing member 224 has a pair of engaging frame portions 226 formed on the opposite upper and lower faces of a rear end of a holding plate portion 228 thereof. Thus, the holding plate portion 228 of the fixing member 224 is fitted in the supporting groove 218 of the resilient locking arm 210 and contacted with the mid portion 220 of the first short-circuiting metal element 222 while the engaging frame portions 226 of the fixing member 224 are engaged with end portions 230 and 232 of the resilient locking arm 210.

The first short-circuiting metal element 222 has a pair of obliquely bent resilient contact portions 234 formed at the opposite ends of the mid portion 220 thereof. The resilient contact portions 234 extend in the opposite directions from the opposite sides of the locking arm 210.

Figure 14:
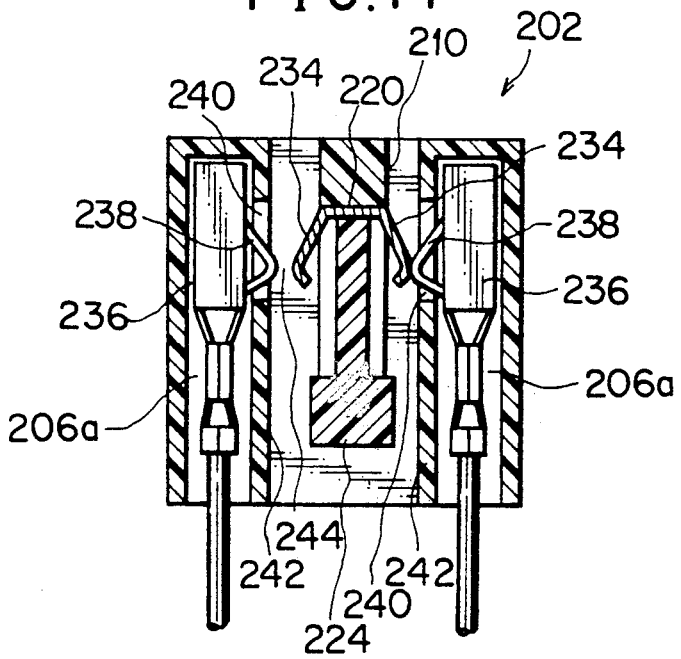
FIG. 14 is a sectional view taken along line XIV—XIV of FIG. 12.

The male connector housing 202 further has a pair of coupling detecting contct elements 236 accommodated and arrested in position in a pair of terminal accommodating chambers 206*a* thereof on the opposite sides of the recessed portion 208 in which the flexible locking arm 210 is provided. Each of the coupling detecting contact elements 236 has a contact piece 238 which extends into the recessed portion 208 through a hole 240 formed in a part partition wall 242 of the male connector housing 202. The contact piece 238 of one of the coupling detecting contact elements 236 contacts with one of the resilient contact portions 234 of the first short-circuiting metal element 222 while the contact piece 238 of the other coupling detecting contact element 236 is opposed to the other resilient contact portion 234 of the first short-circuiting metal element 222 with a gap 244 left therebetween as seen in FIG. 14.

The female connector housing 204 has a plurality of terminal accommodating chambers 246 formed therein and further has a causing portion 248 for accommodating the male connector housing 202 therein. An engaging portion or opening 250 is formed on the casing portion 248 such that it engages with the arresting projection 214 of the resilient locking arm 210 of the male connector housing 202. A fitting wall 252 is formed on an inner face of the casing portion 248 such that it opposes to the gap 244 in the male connector housing 202 mentioned above. A second short-circuiting metal element 254 is fixed to a mid-portion of the fitting wall 252 of the casing portion 248 such that it extends outwardly in the opposite directions from the opposite faces of the fitting wall 252.

Similarly as in the connector apparatus of the preceding embodiments described hereinabove, a female terminal metal element not shown is accomodated in each of the terminal accomodating chambers 206 of the male connector housing 202 while a male terminal metal element not shown is accommodated in each of the terminal accommodating chambers 246 of the female connector housing 204.

Figure 16:
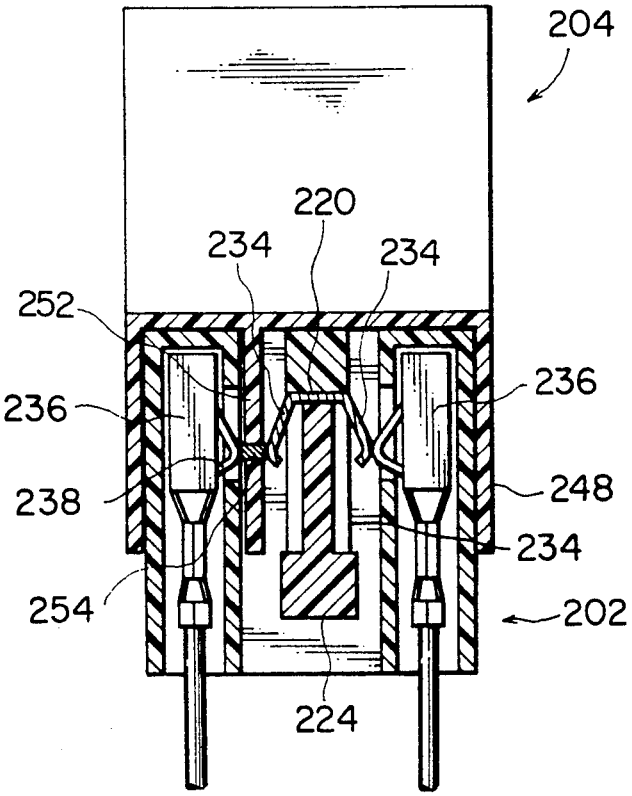
FIG. 16 is a sectional view taken along line XIV—XIV of FIG. 12 but showing the female and male connector housings in a completely coupled condition.
Figure 15A:
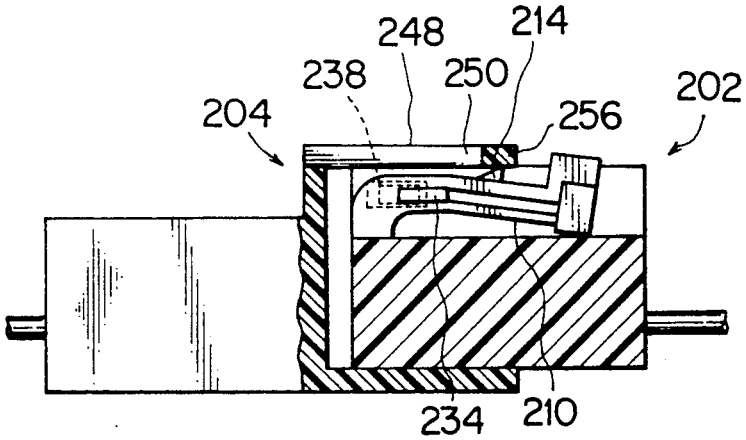
FIGS. 15*a* and 15*b* are longitudinal sectional views of the connector apparatus of FIG. 12 showing female and male connector housings at different stages during a coupling operation.
Figure 15B:
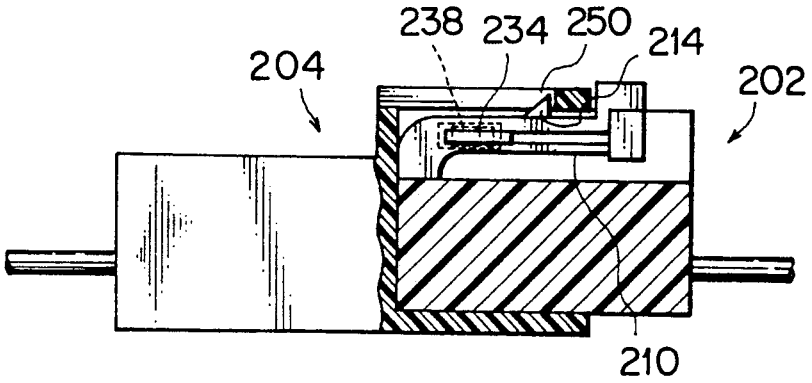

With the connector apparatus of the construction described above, when the female and male connector housings 202 and 204 are coupled to each other, the arresting projection 214 of the resilient locking arm 210 of the male connector housing 202 is engaged and displaced downwardly by an end portion 256 of the casing portion 248 of the female connector housing 204 as seen in FIG. 15*a*. Then, just when the arresting projection 214 rides over the end portion 256 of the casing portion 248, the resilient locking arm 210 restores its original position due to its own resiliency. Consequently, the arresting projection 214 of the resilient locking arm 210 is engaged and arrested by the engaging portion 250 of the casing portion 248, thereby locking the male and female connector housings 202 and 204 in a completely coupled condition to each other. Thereupon, the fitting wall 252 on the casing portion 248 is fitted into the gap 244 described hereinabove until the second short-circuiting metal element 254 therein is contacted at an end thereof with the resilient contact portion 234 of the first short-circuiting metal element 222 and at the other end thereof with the opposing contact piece 238 of the coupling detecting contact element 236 as seen in FIG. 16 to establish an electrical connection between the coupling detecting contact elements 236 in pair to each other. Consequently, the coupling detecting circuit operates and electrically detects such a completely coupled condition of the connector apparatus.

Figure 17:
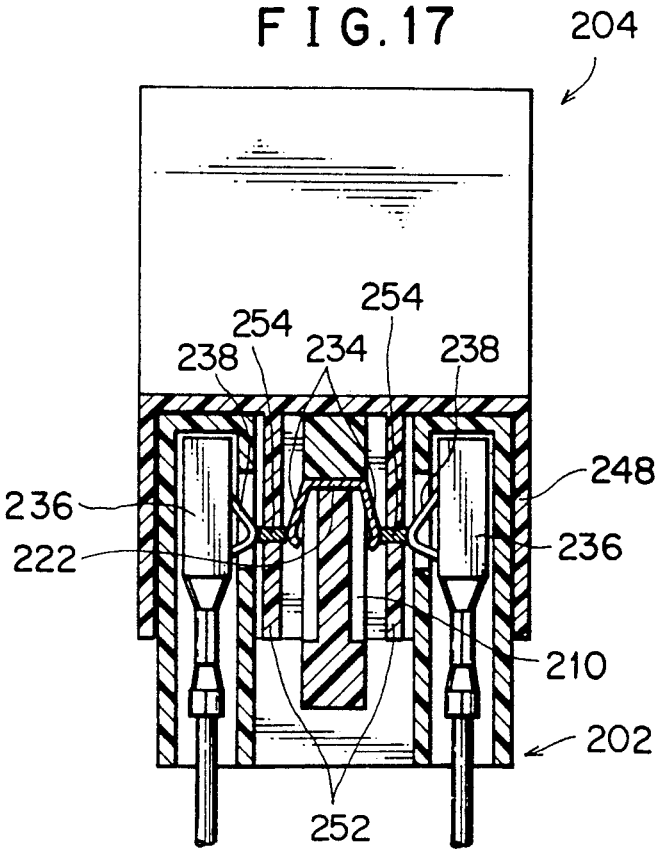
FIGS. 17 to 20 are sectional views similar to FIG. 16 but showing different modifications to the connector apparatus of FIG. 12.

Referring now to FIG. 17, there is shown a modification to the connector apparatus described hereinabove with reference to FIGS. 12 to 16. In the modified connector apparatus, each of the contact pieces 238 of the coupling detecting contact elements 236 in pair is opposed to a corresponding one of the pair of resilient contact portions 234 of the first short-circuiting metal element 222 of the male connector housing 202 while such a gap as the gap 244 described above is left therebetween. Accordingly, a pair of fitting walls 252 are formed on the inner face of the casing portion 248 of the female connector housing 204 in an opposing relationship to the gaps in the male connector housing 202, and a second short-circuiting metal element 254 is fixed to each of the fitting walls 252. Thus, when the male and female connector housings 202 and 204 are coupled completely to each other, an electrical connection between the coupling detecting contact elements 236 is established by the first short-circuiting metal element 222 and pair of second short-circuiting metal elements 254 as seen in FIG. 17.

Figure 18:
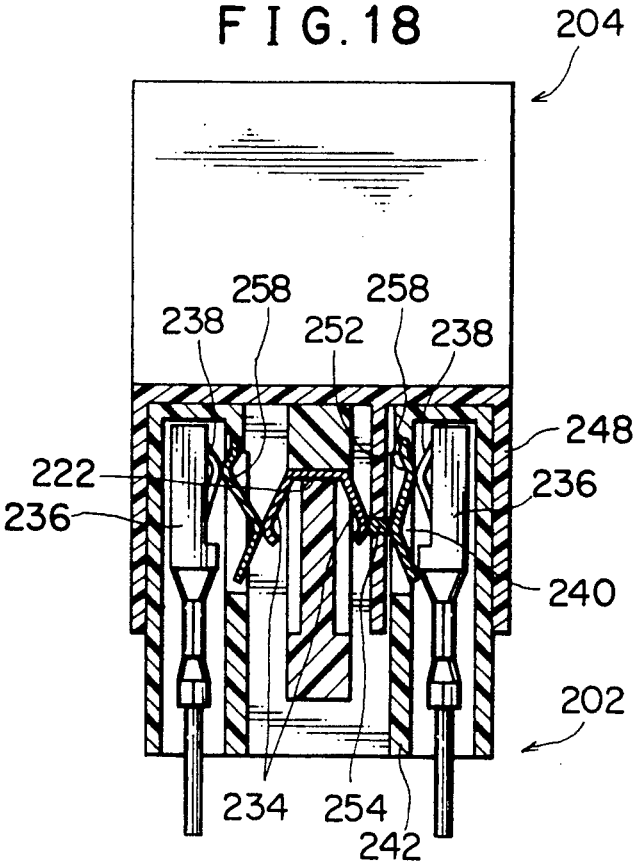

Referring now to FIG. 18, there is shown another modification to the connector apparatus shown in FIGS. 12 to 16. The modified connector apparatus additionally includes a pair of intermediate connecting elements 258 secured in the holes 240 in the partition walls 242 of the male connector housing 202. The intermediate connecting elements 258 are individually held in resilient contact with the contact pieces 238 of the coupling detecting contact elements 236' one of the intermediate connecting elements 258 is held in contact with a corresponding one of the pair of resilient contact portions 234 of the first short-circuiting metal element 222, while the other intermediate connecting element 258 is opposed to the other resilient contact portion 234 of the first short-circuiting metal element 222 with a gap left therebetween.

Thus, when the male connector housing 202 is coupled completely to the female connector housing 204, the fitting wall 252 of the casing portion 248 of the female connector housing 204 is fitted in the gap mentioned above, and the second short-circuiting metal element 254 fixed to the fitting wall 252 short-circuits the coupling detecting contact element 236 and first short-circuiting metal element 222 defining the gap therebetween, thereby establishing electric connection between the coupling detecting contact elements 236.

Figure 19:
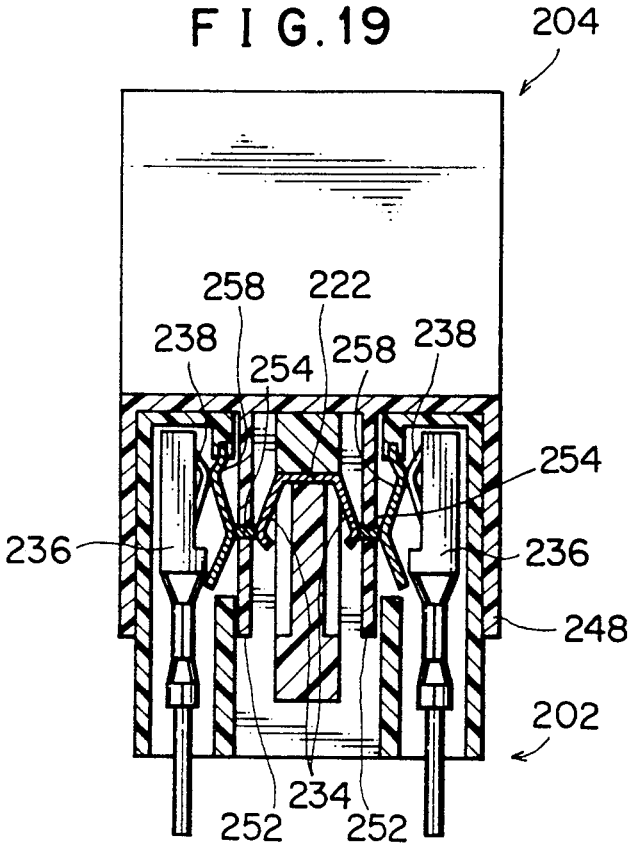

Referring now to FIG. 19, there is shown a further modification to the connector apparatus shown in FIGS. 12 to 16. The present modified connector apparatus includes a pair of intermediate connecting elements 258 similar to the intermediate connecting elements 258 in the connector apparatus shown in FIG. 18. Further, the female connector housing 204 of the present modified connector apparatus has a pair of fitting walls 252 provided on the inner face of the casing portion 248 thereof similar to the case of the female connector housing 204 of the connector apparatus shown in FIG. 17. The fitting walls 252 are fitted in the gaps between the pair of resilient contact portions 234 of the first short-circuiting metal element 222 and the intermediate connecting elements 258 of the male connector housing 202. The second short-circuiting metal elements 254 fixed to the fitting walls 252 are contacted with the resilient contact portions 234 of the first short-circuiting metal element 222 and the intermediate connecting elements 258. Consequently, an electrical connection between the coupling detecting contact elements 236 is established by way of the intermediate connecting elements 258, first short-circuiting metal element 222 and second short-circuiting metal elements 254.

Figure 20:
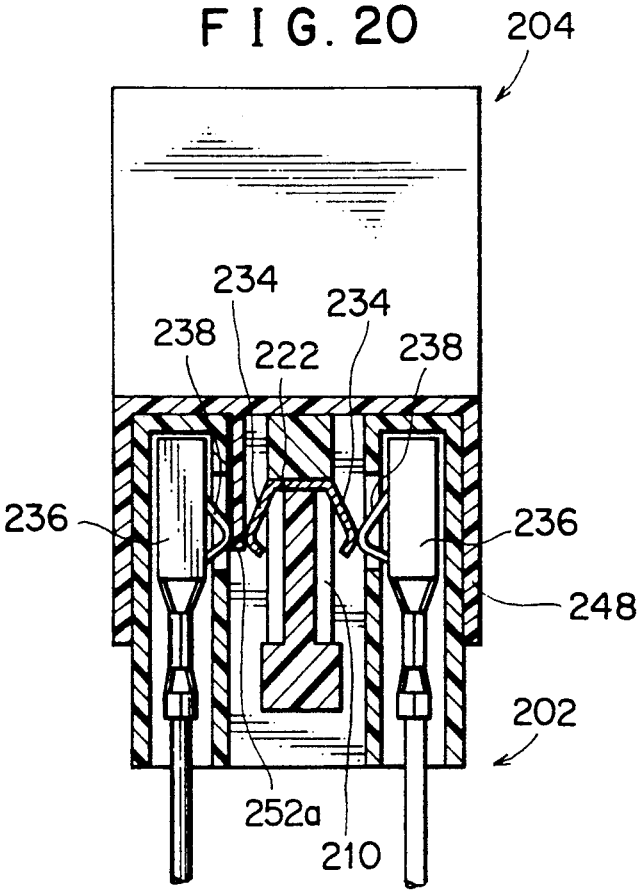
Figure 21:
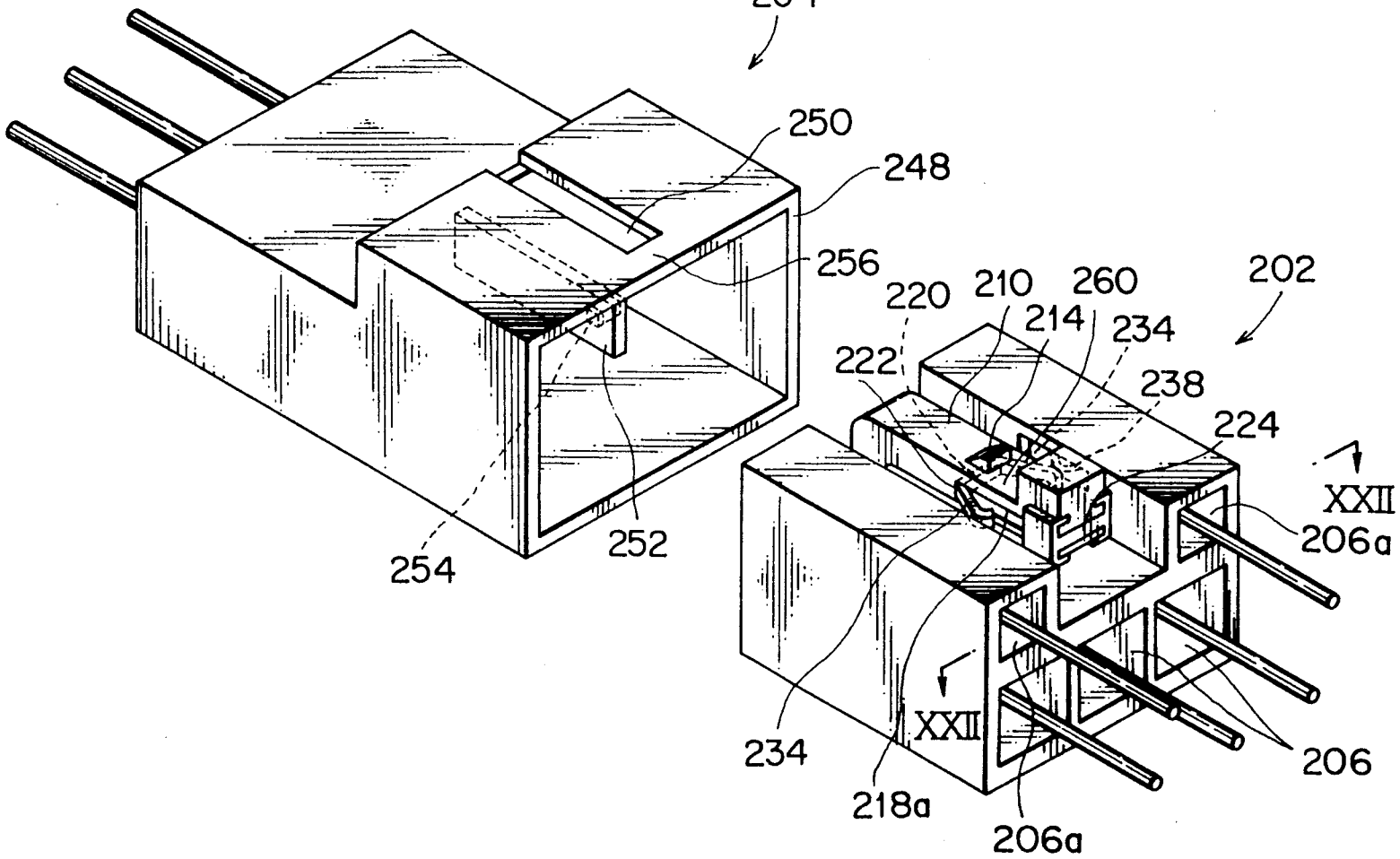
FIG. 21 is a fragmentary perspective view of a different modification to the connector apparatus of FIG. 12.
Figure 22:
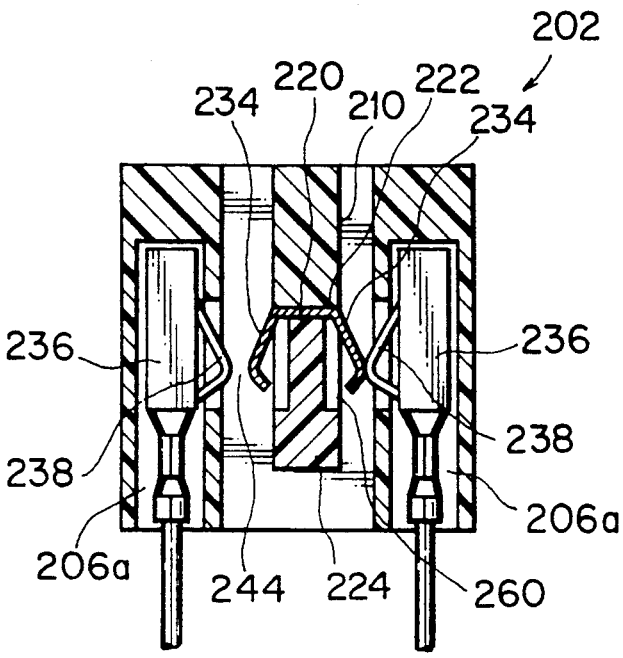
FIG. 22 is a sectional view taken along line XXII—XXII of FIG. 21.
Figure 29:
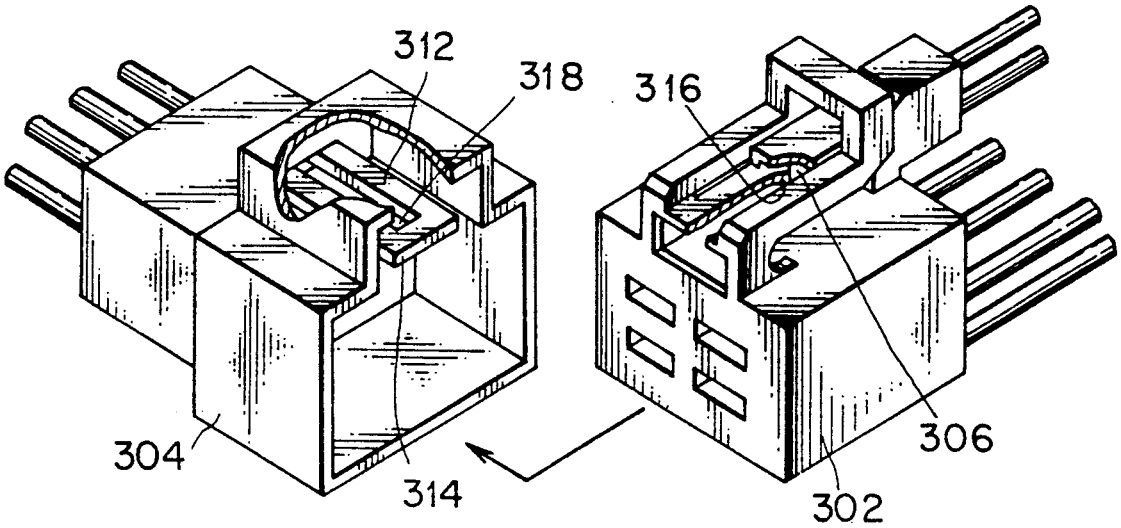
FIG. 29 PRIOR ART
FIG. 29 is a fragmentary perspective view, partly broken, showing an exemplary conventional connector apparatus.

Referring now to FIG. 20, there is shown an even further modification to the connector apparatus shown in FIGS. 12 to 16. In the present modified connector apparatus, the coupling detecting circuit electrically detects a completely coupled condition of the connector apparatus when an electrical connection between the coupling detecting contact elements 236 is interrupted. In particular, when the male and female connector housings 202 and 204 are not coupled completely to each other, the pair of resilient contact portions 234 of the first short-circuiting metal element 222 of the male connector housing 202 are held in contact with the contact pieces 238 of the opposing coupling detecting contact elements 236 to establish the electrical connection between the coupling detecting contact elements 236. Meanwhile, a modified fitting wall 252*a* is formed on the inner wall of the casing portion 248 of the female connector housing 204 in an opposing relationship to a location at which one of the resilient contact portions 234 of the first short-circuiting metal element 222 contacts with the contact piece 238 of the corresponding one of the coupling detecting contact elements 236. Thus, when the male and female connector housings 202 and 204 are coupled completely to each other, it enters between the one resilient contact portion 234 of the first short-circuiting metal element 222 and the contact piece 238 of the corresponding coupling detecting contact element 236, thereby interrupting the electrical connection between the coupling detecting contact elements 236.

Referring now to FIGS. 21 to 25, there is shown a yet further modification to the connector apparatus shown in FIGS. 12 to 16. The resilient locking arm 210 of the male connector housing 202 of the present modified connector apparatus has, in place of the deep supporting groove 218, a shallow supporting groove 218*a* formed in a longitudinal direction from an end portion thereof. The mid portion 220 of the first short-circuiting metal element 222 is inserted in the supporting groove 218*a* and fixed to a free end side movable or displaceable portion 260 of the resilient locking arm 210 by the fixing member 224. One of the resilient contact portions 234 of the first short-circuiting metal element 222 is held in contact with the contact piece 238 of a corresponding one of the coupling detecting contact elements 236 accomodated in the terminal accommodating chambers 206*a* of the male connector housing 202 while the other resilient contact portion 234 of the first short-circuiting metal element 222 is opposed to the contact piece 238 of the other coupling detecting contact element 236 with a gap 244 left therebetween.

Meanwhile, the fitting wall 252 is formed on the inner face of the casing portion 248 of the female connector housing 204 in an opposing relationship to the gap 244 mentioned above, and the second short-circuiting 254 is fixed at a comparatively forward location of the fitting wall 252.

Figure 23A:
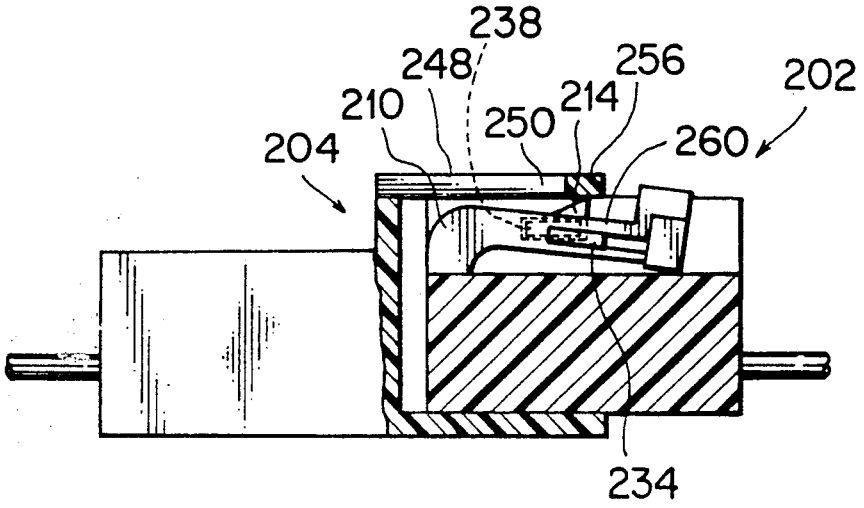
FIGS. 23*a*, 23*b* and 24*a*, 24*b* are vertical sectional views and end elevational views, respectively, of the connector apparatus of FIG. 22 showing female and male connector housings at different stages during a coupling operation.
Figure 23B:
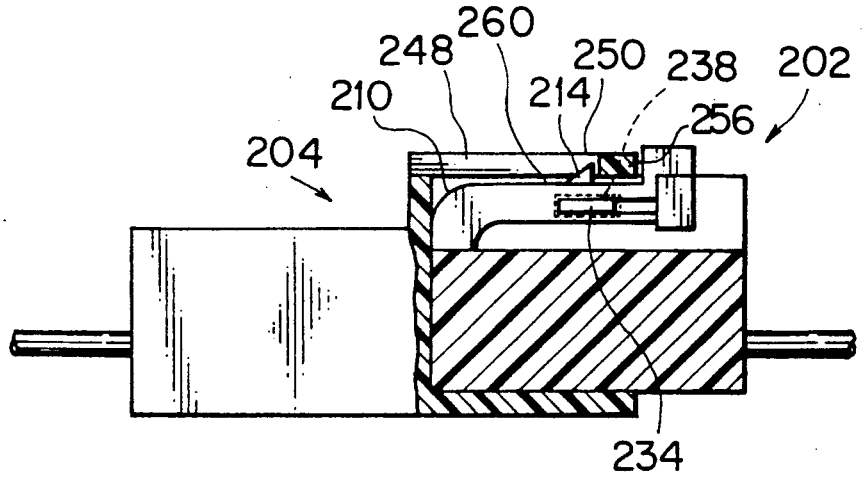
Figure 24A:
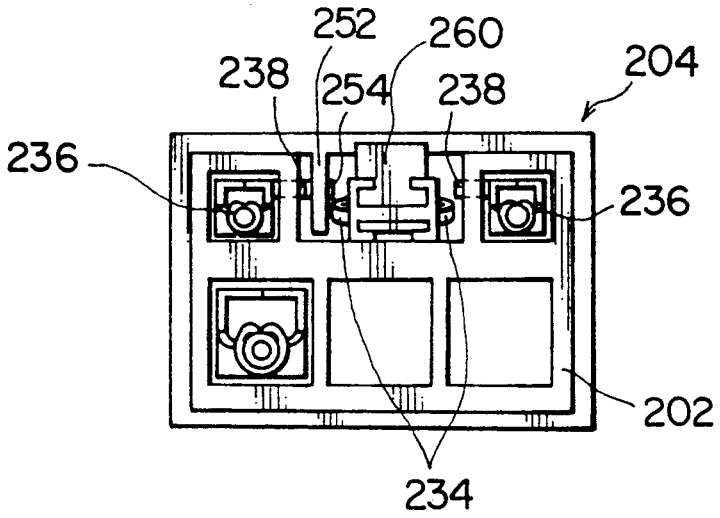
Figure 24B:
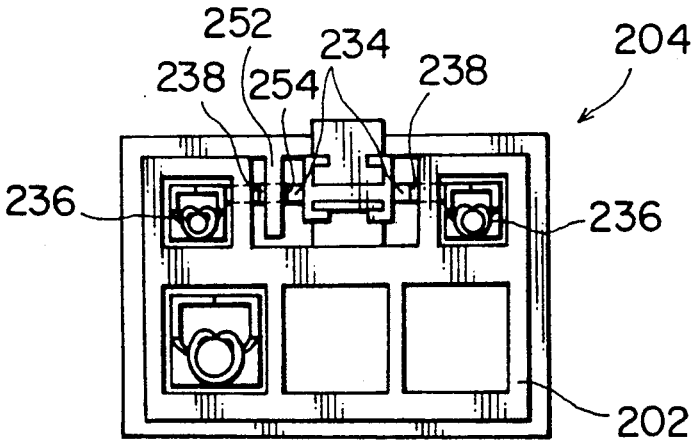
Figure 25:
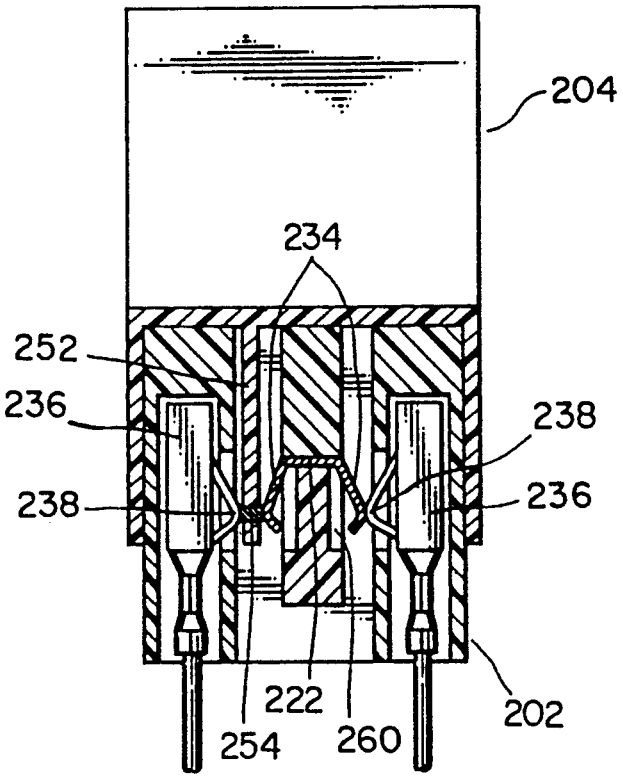
FIG. 25 is a sectional view taken along line XXII—XXII of FIG. 21 but showing the female and male connector housings in a completely coupled condition.

With the modified connector apparatus of the construction described above, when the female and male connector housings 202 and 204 are coupled to each other, the arresting projection 214 of the resilient locking arm 210 of the male connector housing 202 is engaged and displaced downwardly by the end portion 256 of the casing portion 248 of the female connector housing 204 together with the first short-circuiting metal element 222. The resilient contact portion 234 of the first short-circuiting metal element 222, which has been held in contact with the contact piece 238 of the corresponding coupling detecting contact element 236, is brought out of contact with the contact piece 238 as seen in FIGS. 23*a* and 24*a*. Then, just when the arresting projection 214 rides over the end portion 256 of the casing portion 248, the resilient locking arm 210 is restored its original position due to its own resiliency. Consequently, the arresting projection 214 of the resilient locking arm 210 is engaged and arrested by the engaging portion 250 of the casing portion 248, thereby locking the male and female connector housings 202 and 204 in a completely coupled condition to each other. Thereupon, the resilient contact portion 234 of the first short-circuiting metal element 222, which has been brought out of contact with the contact piece 238 of the corresponding coupling detecting element 236 once, is brought into contact again with the contact piece 238 of the corresponding coupling detecting contact element 236. Simultaneously, the fitting wall 252 on the casing portion 248 is fitted into the gap 244 described above until the second short-circuiting metal element 254 therein is contacted with the other resilient contact portion 234 of the first short-circuiting metal element 222 and the contact piece 238 of the corresponding coupling detecting contact element 6 as seen in FIGS. 23*b*, 24*b* and 25 so as to establish an electrical connection between the coupling detecting contact elements 236 in pairs to each other. Consequently, the coupling detecting circuit operates and electrically detects the completely coupled condition of the connector apparatus.

Figure 26:
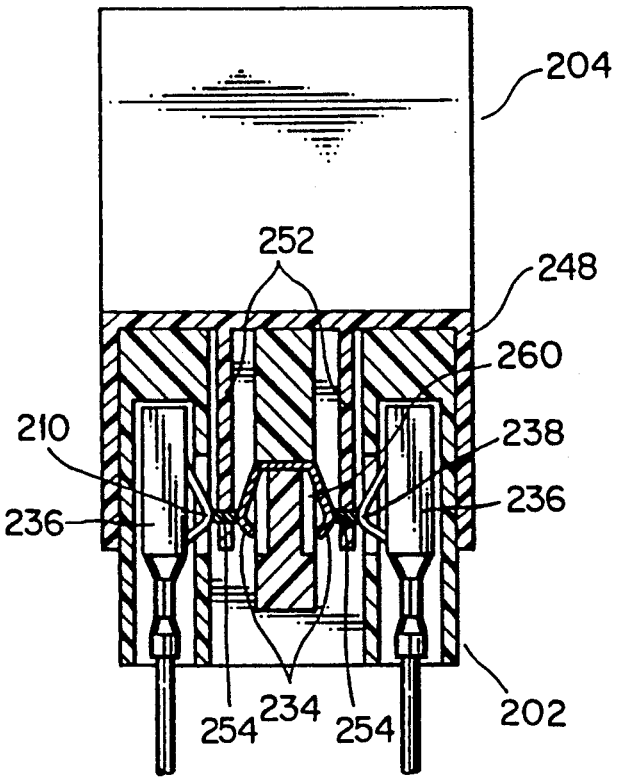
FIGS. 26 to 28 are sectional views similar to FIG. 25 but showing different modifications to the connector apparatus of FIG. 21.

Referring now to FIG. 26, there is shown a modification to the modified connector apparatus described hereinabove with reference to FIGS. 21 to 25. The present modified connector apparatus is similar in construction to the connector apparatus of FIG. 17. Each of the contact pieces 238 of the coupling detecting contact elements 236 in pair is opposed to a corresponding one of the pairs of resilient contact portions 234 of the first short-circuiting metal element 222 provided at the movable or displaceable portion 260 of the resilient locking arm 210 of the male connector housing 202 with a gap left therebetween. A pair of fitting walls 252 are formed on the inner face of the casing portion 248 of the female connector housing 204 in an opposing relationship to the gaps in the male connector housing 202. A second short-circuiting metal element 254 is fixed to each of the fitting walls 252.

Figure 27:
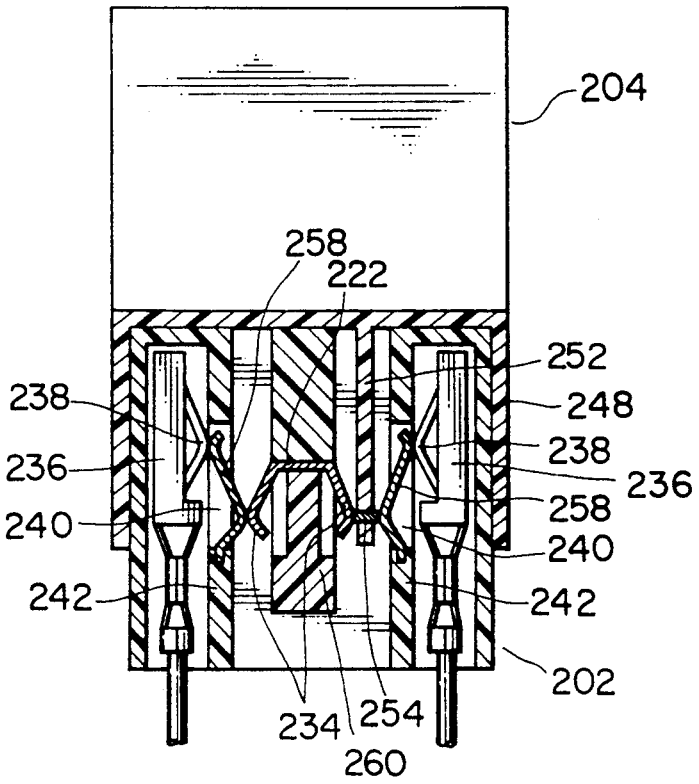

Referring now to FIG. 27, there is shown another modification to the modified connector apparatus shown in FIGS. 21 to 25. The present modified connector apparatus is similar in construction to the connector apparatus shown in FIG. 28. In particular, a pair of intermediate connecting elements 258 are secured in the holes 240 in the partition walls 242 of the male connector housing 202. The intermediate connecting elements 258 are individually held in resilient contact with the contact pieces 238 of the coupling detecting contact elements 236. One of the intermediate connecting elements 258 is held in contact with a corresponding one of the pair of resilient contact portions 234 of the first short-circuiting metal element 222, while the other intermediate connecting element 258 is opposed to the other resilient contact portion 234 of the first short-circuiting metal element 222 with a gap left therebetween. Meanwhile, the fitting wall 252 is provided on the inner face of the casing portion 248 of the female connector housing 204 in an opposing relationship to the gap. The second short-circuiting metal element 254 is fixed to the fitting wall 252.

Figure 28:
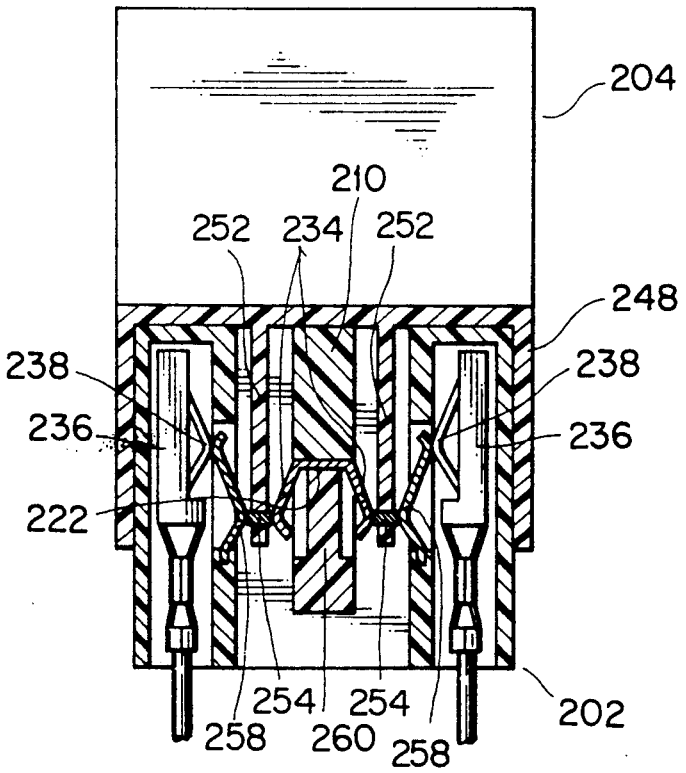
Figure 30A:
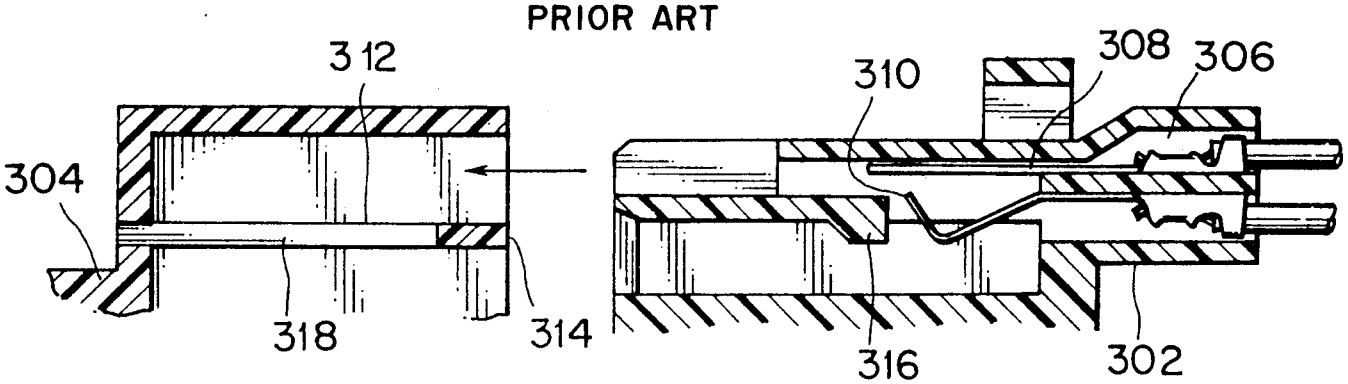
FIG. 30a PRIOR ART
FIGS. 30*a* and 30*b* are longitudinal sectional views of the connector apparatus of FIG. 29 showing connector housings at different stages during a coupling operation.
Figure 30B:
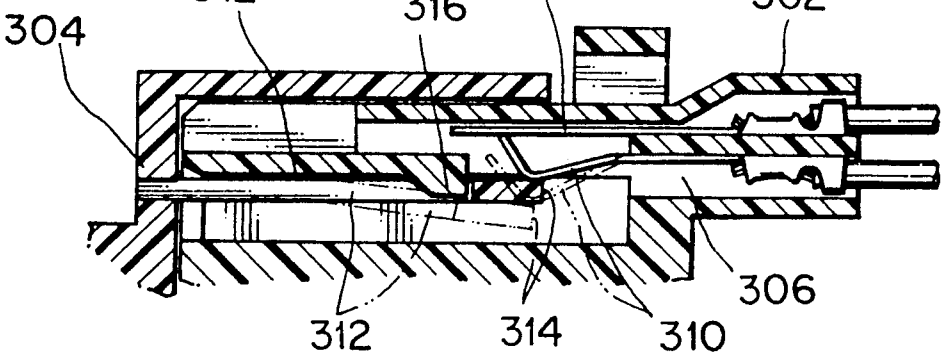
FIG. 30b PRIOR ART
Figure 31:
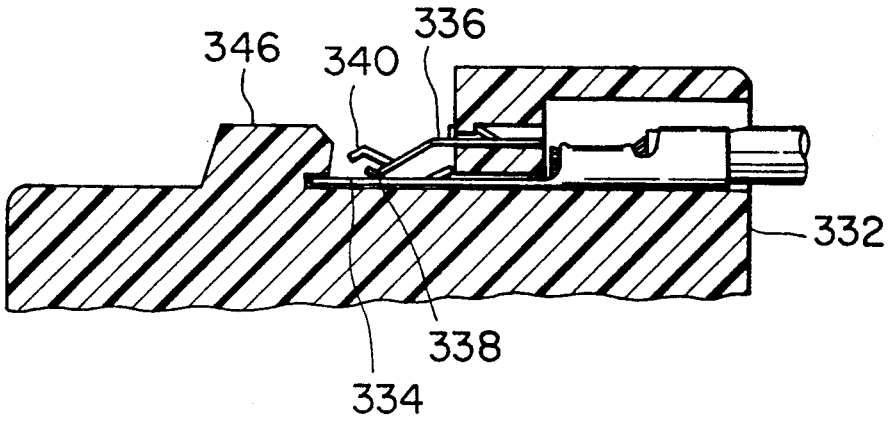
FIG. 31 PRIOR ART
FIG. 31 is a longitudinal sectional view of a connector housing showing another exemplary conventional connector apparatus.
Figure 32:
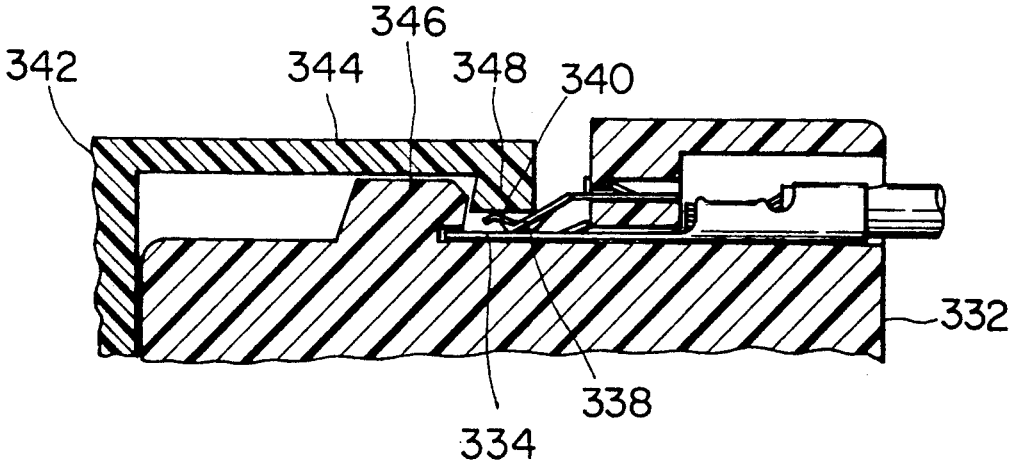
FIG. 32 PRIOR ART
FIG. 32 is a view similar to FIG. 31 but showing the connector housing to which a companion connector housing is coupled.

Referring now to FIG. 28, there is shown a further modification to the modified connector apparatus shown in FIGS. 21 to 25. The present modified connector apparatus is similar in construction to the connector apparatus shown in FIG. 19 and includes a pair of intermediate connecting elements 258 similar to the intermediate connecting elements 258 in the connector apparatus shown in FIG. 27. Further, the female connector housing 204 of the present modified connector apparatus has a pair of fitting walls 252 provided on the inner face of the casing portion 248 thereof similar to the case of the female connector housing B7 of the connector apparatus shown in FIG. 26. The fitting walls 252 of the casing portion 248 of the female connector housing 204 are thus fitted in the gaps between the pair of resilient contact portions 234 of the first short-circuiting metal element 222 provided at the movable or displaceable portion 260 of the resilient locking arm 210 and the intermediate connecting elements 258 of the male connector housing 202. The second short-circuiting metal elements 254 fixed to the fitting walls 252 are contacted with the resilient contact portions 234 of the first short-circuiting metal element 222 and the intermediate connecting elements 258.

Having now fully described the invention, it will, be apparent to one of ordinary skill in the art that many changes and modifications can be made thereto without departing from the spirit and scope of the invention as set forth herein.

What is claimed is:

1. A converter apparatus, comprising:

first and second connector housings, one of said first and second housings having secured therein at least one of male and female terminal elements while another of said first and second housings having secured therein at least one of another corresponding male and female terminal elements;

a resilient locking arm provided on said first connector housing;

an engaging element provided on said second connector housing for engaging with said resilient locking arm to lock said first and second connector housing in a completely coupled condition;

a pair of coupling detecting contact elements disposed in a spacing of said first connector housing which allows resilient movement of said resilient locking arm therein; and a short-circuiting contact element for establishing an electrical connection between said coupling detecting contact elements, said short-circuiting contact element being secured within said engaging element of said second connector housing, each of said coupling detecting contact elements having a contact portion which is displaced away from said short-circuiting contact element in response to displacement of said resilient locking arm, said resilient locking arm being constructed such that said engaging element does not interfere with said resilient locking arm, when said first and second connector housings are coupled completely to each other, thereby allowing said resilient locking arm to assume an operative position at which said coupling detecting contact elements contact with said short-circuiting contact element to establish the electrical connection between said coupling detecting contact elements, but when said first and second connector housings are not coupled completely to each other, said engaging element engages with and displaces said resilient locking arm from the operative position to interrupt the electrical connection between said coupling detecting contact elements.

2. A connector apparatus as claimed in claim 1, wherein each of said coupling detecting contact elements has a resilient contact portion which is erected obliquely upwardly in an opposing relationship to said resilient locking arm in said spacing.

3. A connector apparatus as claimed in claim 2, wherein each of said coupling detecting contact elements further has a terminal portion formed thereon, which is positioned in one of a plurality of terminal accommodating chambers formed in said first connector housing.

4. A connector apparatus as claimed in claim 1, wherein each of said coupling detecting contact elements has a resilient folded back portion which is disposed along an inner face of said resilient locking arm and a surface of said first connector housing, and further has a contact portion fixed to a free end portion of said resilient locking arm.

5. A connector apparatus as claimed in claim 4, wherein each of said coupling detecting contact elements has a projected terminal portion formed thereon, which is projected, through a through-hole formed in said first connector housing, into one of a plurality of terminal accommodating chambers formed in said first connector housing.

6. A connector apparatus as claimed in claim 3 or 5, wherein a terminal element similar to terminal elements which are inserted and arrested in position in the terminal accommodating chambers of said first connector housing is fitted in one terminal accommodating chamber and connected to said terminal portion of each of said coupling detecting contact elements to form part of a coupling detecting circuit.

7. A connector apparatus, comprising:

first and second connector housings, one of said first and second housings having secured therein at least one of male and female terminal elements while another of said first and second housings having secured therein at least one of another corresponding male and female terminal elements;

a resilient locking arm provided on said first connector housing;

an engaging element provided on said second connector housing for engaging with said resilient locking arm to lock said first and second connector housings in a completely coupled condition;

a pair of resilient coupling detecting contact elements provided on said first connector housing; and a short-circuiting contact element secured to said second connector housing, each of said coupling detecting contact elements having a contact portion which is displaced away from said short-circuiting contact element in response to displacement of said resilient locking arm, said resilient locking arm being constructed such that, said engaging element does not interfere with said resilient locking arm when said first and second connector housings are coupled completely to each other, thereby allowing said resilient locking arm to assume an operative position at which said coupling detecting contact elements contact at the resilient contact ends thereof with said short-circuiting contact element to establish electric connection between said coupling detecting contact elements, but when said first and second connector housings are not coupled completely to each other, said engaging element engages with and displaces said resilient locking arm away from the operative position to interrupt electric connection between said coupling detecting contact elements.

8. A connector apparatus as claimed in claim 7, wherein each of said resilient coupling detecting contact elements has a fixing contact plate portion at which it is fixed to said first connector housing, and a third connector housing for a coupling detecting circuit is connected to said first connector housing such that a pair of detecting terminal metal elements built in said third connector housing are held in contact with the fixing contact plate portions of said resilient coupling detecting contact elements.

* * * * *